US012545305B2

(12) United States Patent
Fujihara et al.

(10) Patent No.: US 12,545,305 B2
(45) Date of Patent: Feb. 10, 2026

(54) RAIL YARD TRAIN-SWITCHING SYSTEM, CONTROL DEVICE, AND CONTROL METHOD

(71) Applicant: Mitsubishi Electric Corporation, Tokyo (JP)

(72) Inventors: Maho Fujihara, Tokyo (JP); Daisuke Tateishi, Tokyo (JP); Hideo Nakata, Tokyo (JP); Masaaki Sugimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 312 days.

(21) Appl. No.: 17/912,941

(22) PCT Filed: May 12, 2020

(86) PCT No.: PCT/JP2020/019035
§ 371 (c)(1),
(2) Date: Sep. 20, 2022

(87) PCT Pub. No.: WO2021/229701
PCT Pub. Date: Nov. 18, 2021

(65) Prior Publication Data
US 2023/0202543 A1 Jun. 29, 2023

(51) Int. Cl.
*B61L 27/04* (2006.01)
*B61L 27/10* (2022.01)
*B61L 27/16* (2022.01)

(52) U.S. Cl.
CPC ..... *B61L 27/10* (2022.01); *B61L 27/04* (2013.01); *B61L 27/16* (2022.01)

(58) Field of Classification Search
CPC ..... B61L 23/14; B61L 27/00; B61L 27/04; B61L 27/10; B61L 27/16; B61L 27/57; B61L 99/002; B61L 2210/002
(Continued)

(56) References Cited

U.S. PATENT DOCUMENTS 6,446,912 B1 * 9/2002 Barich ..... B61L 27/57 246/2 R
10,293,842 B2 5/2019 Miyajima et al.
(Continued)

FOREIGN PATENT DOCUMENTS

CN 1559847 A 1/2005
CN 101121411 A 2/2008
(Continued)

OTHER PUBLICATIONS

International Search Report (PCT/ISA/210) with translation and Written Opinion (PCT/ISA/237) mailed on Jul. 14, 2020, by the Japan Patent Office as the International Searching Authority for International Application No. PCT/JP2020/019035. (8 pages).
First Office Action dated Nov. 29, 2023, issued in the corresponding Chinese Patent Application No. 202080100309.1, 25 pages including 15 pages of English Translation.
Office Action issued in corresponding India Patent Application No. 202227058415, dated Jan. 5, 2023, 5 pages.
Extended European Search Report dated May 25, 2023, issued in the corresponding European Patent Application No. 20935379.6, 9 pages.
(Continued)

*Primary Examiner* — Erick R Solis
(74) *Attorney, Agent, or Firm* — Buchanan Ingersoll & Rooney PC

(57) ABSTRACT

A rail yard train-switching system includes train-moving machines and a control device. The train-moving machines each draw one of railroad trains in a rail yard. The control device transmits a traction command to the train-moving machines based on an operation schedule. The train-moving machines each move, based on the traction command transmitted from the control device, to a first location specified by the traction command to couple with an appropriate one of the railroad trains, and draw the one of the railroad trains from the first location to a second location specified by the traction command.

6 Claims, 12 Drawing Sheets

(58) Field of Classification Search
USPC ..... 701/19, 20, 23, 25
See application file for complete search history.

(56) References Cited

U.S. PATENT DOCUMENTS

| | | | | |
|---|---|---|---|---|
| 2017/0043793 | A1* | 2/2017 | Evans | B61C 9/14 |
| 2019/0106125 | A1* | 4/2019 | Looney | B60L 15/2036 |
| 2019/0359238 | A1 | 11/2019 | Ding et al. | |
| 2019/0367062 | A1* | 12/2019 | Brooks | B61L 27/12 |
| 2024/0166246 | A1* | 5/2024 | Hathaway | B61B 1/005 |

FOREIGN PATENT DOCUMENTS

| | | | |
|---|---|---|---|
| CN | 105243381 | A | 1/2016 |
| CN | 108639108 | A | 10/2018 |
| JP | H1081236 | A | 3/1998 |
| JP | 2007001519 | A | 1/2007 |
| JP | 2013045329 | A | 3/2013 |
| KR | 19990064774 | A | 8/1999 |
| WO | 2014155731 | A1 | 10/2014 |

OTHER PUBLICATIONS

Smagin, et al., "Technologie und Prinzipien des Betriebs lokfuhrerloser Rangierlokomotiven auf dem Rangierbahnhof Luzhskaya—The technology and operating concept for driverless shunting locomotives at Luzhskaya Marshalling Yard", Signalling & Datacommunication, vol. 110, No. 12, Dec. 10, 2018, pp. 30-38.

The Third Office Action dated Oct. 19, 2024, issued in the corresponding Chinese Patent Application No. 202080100309.1, 18 pages including 11 pages of English Translation.

Second Office Action dated Jul. 2, 2024, issued in the corresponding Chinese Patent Application 202080100309.1, 20 pages including 12 pages of English Translation.

Decision of Refusal dated Dec. 23, 2024, issued in the corresponding Chinese Patent Application No. 202080100309.1, 23 pages including 15 pages of English Translation.

* cited by examiner

FIG.3

| OPERATION ID | START TIME | OPERATED TRAIN | TRACTION START LOCATION | TRACTION END LOCATION |
|---|---|---|---|---|
| O1 | 9:25 | TRAIN UNIT F2 | BOUNDARY BETWEEN MAIN LINE END SECTION AND RAIL YARD | INSPECTION LOCATION |
| O2 | 9:40 | TRAIN UNIT G1 | BOUNDARY BETWEEN MAIN LINE END SECTION AND RAIL YARD | CLEANING LOCATION |
| O3 | 10:30 | TRAIN UNIT G2 | BOUNDARY BETWEEN MAIN LINE END SECTION AND RAIL YARD | REPLACEMENT LOCATION |
| O4 | 11:00 | TRAIN UNIT Z3 | BOUNDARY BETWEEN MAIN LINE END SECTION AND RAIL YARD | GRINDING LOCATION |
| ⋮ | ⋮ | ⋮ | ⋮ | ⋮ |

FIG.4

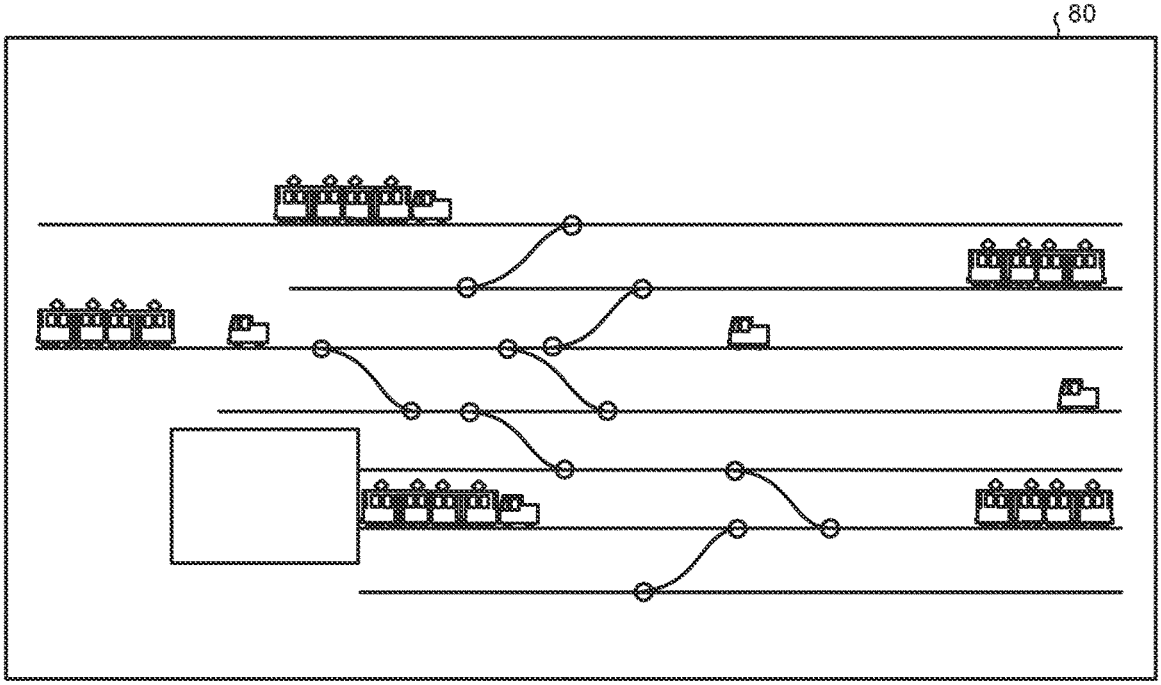

81

| START TIME | OPERATED TRAIN | STORAGE LOCATION |
|---|---|---|
| 9:25 | TRAIN UNIT F2 | INSPECTION LOCATION |
| 9:40 | TRAIN UNIT G1 | CLEANING LOCATION |
| 10:30 | TRAIN UNIT G2 | REPLACEMENT LOCATION |
| 11:00 | TRAIN UNIT Z3 | GRINDING LOCATION |
| ⋮ | ⋮ | ⋮ |

RAIL YARD TRAIN-SWITCHING SYSTEM, CONTROL DEVICE, AND CONTROL METHOD

FIELD

The present disclosure relates to a rail yard train-switching system for switching a railroad train (hereinafter referred to simply as train) in a rail yard of a railroad system, and to a control device, a control method, and a control program.

BACKGROUND

In a rail yard of a railroad system, a train is conventionally switched by a motorman operating a train-moving machine. Train switching operation includes, for example, traction of a train in an end section of a main line to a storage location in the rail yard, movement of a train stored in the rail yard to a location of a washer or of an inspection and repair shop in the rail yard, and the like.

A technology is also known of performing a train switching operation by controlling the train itself rather than performing a train switching operation using a train-moving machine. For example, Patent Literature 1 suggests a train remote control assistance system that allows an operator to remotely control a train switching operation.

CITATION LIST

Patent Literature

Patent Literature 1: Japanese Patent Application Laid-open No. 2007-1519

SUMMARY

Technical Problem

However, the foregoing conventional technology requires a qualified motorman or operator to remotely control a train switching operation. In addition, remote control functionality needs to be installed in all the trains to be switched, which will lead to high cost.

The present disclosure has been made in view of the foregoing, and it is an object of the present disclosure to provide a rail yard train-switching system that enables a train switching operation to be efficiently performed in a rail yard.

Solution to Problem

To solve the problem and achieve the object described above, a rail yard train-switching system of the present disclosure includes a train-moving machine and a control device. The train-moving machine draws a train in a rail yard. The control device transmits a traction command to the train-moving machine based on an operation schedule. The train-moving machine moves, based on the traction command transmitted from the control device, to a first location specified by the traction command to couple with the train, and draws the train from the first location to a second location specified by the traction command.

Advantageous Effects of Invention

The present disclosure provides an advantage in enabling a train switching operation to be efficiently performed in a rail yard.

BRIEF DESCRIPTION OF DRAWINGS

FIG. 3 is a diagram illustrating an example of operation schedule information according to the first embodiment.

FIG. 4 is a diagram illustrating an example of monitor image displayed on a monitor terminal in a central control room according to the first embodiment.

DESCRIPTION OF EMBODIMENTS

A rail yard train-switching system, a control device, a control method, and a control program according to an embodiment will be described in detail below with reference to the drawings.

First Embodiment

Figure 1:
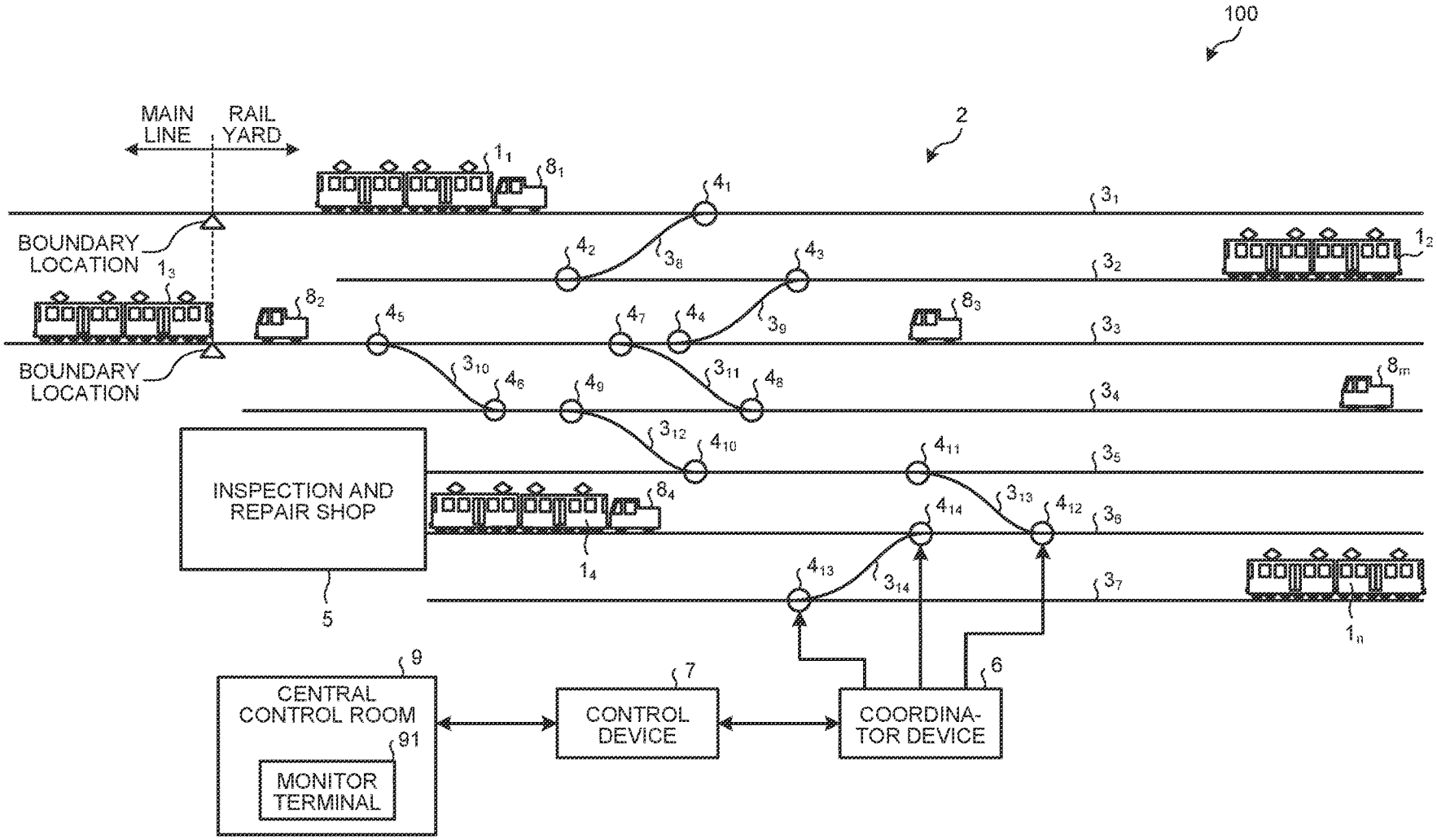
FIG. 1 is a diagram illustrating an example configuration of a rail yard train-switching system according to a first embodiment.

FIG. 1 is a diagram illustrating an example configuration of a rail yard train-switching system according to a first embodiment. As illustrated in FIG. 1, a rail yard train-switching system 100 according to the first embodiment performs switching of multiple trains $\mathbf{1}_1$, $\mathbf{1}_2$, $\mathbf{1}_3$, $\mathbf{1}_4$, . . . , and $\mathbf{1}_n$ in a rail yard 2, where n is, for example, an integer greater than or equal to 5. The multiple trains $\mathbf{1}_1$, $\mathbf{1}_2$, $\mathbf{1}_3$, $\mathbf{1}_4$, . . . , and $\mathbf{1}_n$ may each be referred to hereinafter as train 1 when no distinction is made. Note that the example illustrated in FIG. 1 illustrates the trains 1 each as a train formed of multiple vehicles coupled together, but the trains 1 may be formed of a single vehicle.

The rail yard 2 includes multiple tracks $\mathbf{3}_1$ to $\mathbf{3}_{14}$, multiple switches $\mathbf{4}_1$ to $\mathbf{4}_{14}$, an inspection and repair shop 5, and a coordinator device 6. On at least part of each of the multiple tracks $\mathbf{3}_1$ to $\mathbf{3}_7$, one of the trains 1 is stored for a purpose such as scheduled inspection of the train 1, washing of the body of the train 1, replacement of a component of the train 1, or grinding of the body or a component of the train 1. The multiple tracks $\mathbf{3}_1$ to $\mathbf{3}_{14}$ may each be referred to hereinafter as track 3 when no distinction is made.

The coordinator device 6 controls the multiple switches $\mathbf{4}_1$ to $\mathbf{4}_{14}$. The multiple switches $\mathbf{4}_1$ to $\mathbf{4}_{14}$ may each be referred to hereinafter as switch 4 when no distinction is made.

The rail yard train-switching system 100 includes a control device 7, multiple train-moving machines $\mathbf{8}_1$, $\mathbf{8}_2$, $\mathbf{8}_3$, $\mathbf{8}_4$, . . . , and $\mathbf{8}_m$, and a monitor terminal 91 of a central control room 9. The multiple train-moving machines $\mathbf{8}_1$, $\mathbf{8}_2$, $\mathbf{8}_3$, $\mathbf{8}_4$, . . . , and $\mathbf{8}_m$ may each be referred to hereinafter as train-moving machine 8 when no distinction is made.

The control device 7 is communicatively connected to each of the coordinator device 6 and the central control room 9. The control device 7, for example, transmits a switch command to the coordinator device 6 to drive the coordinator device 6 to switch the switch 4 corresponding to the switch command.

In addition, the control device 7 outputs, to the central control room 9, state information representing the states of the respective train-moving machines 8, the states of the respective trains 1, the states of the respective switches 4, and the like. The central control room 9 includes the monitor terminal 91. The monitor terminal 91 displays information such as the states of the respective train-moving machines 8, the states of the respective trains 1, and the states of the respective switches 4 on a display unit not illustrated. This allows the operator of the central control room 9 to know information such as the states of the respective train-moving machines 8, the states of the respective trains 1, and the states of the respective switches 4. The operator of the central control room 9 may be hereinafter referred to simply as operator.

The monitor terminal 91 of the central control room 9 has a control portion for receiving an operation of the operator. An operation performed by the operator on such control portion causes a control command to be notified from the monitor terminal 91 of the central control room 9 to the control device 7. The control device 7 controls the multiple train-moving machines 8 and the multiple switches 4 based on a control command notified from the monitor terminal 91 of the central control room 9.

The control device 7 controls the multiple train-moving machines 8 and the multiple switches 4 also based on a preconfigured operation schedule. For example, the control device 7 transmits a traction command to each corresponding one of the multiple train-moving machines 8 based on the preconfigured operation schedule. A traction command includes information such as, for example, a traction start location, a traction end location, and a travel route. The control device 7 also controls one or more of the multiple switches 4 to establish the travel route of one of the train-moving machines 8 based on the travel route of that train-moving machine 8.

Each of the train-moving machines 8 moves, based on the traction command transmitted from the control device 7, to a first location specified by the traction command to couple with a train 1, and draws the train 1 from the traction start location to the traction end location. The traction start location is the location to make the train-moving machine 8 start traction of a train 1, while the traction end location is the location to make the train-moving machine 8 terminate the traction of the train 1. The traction start location is an example of the first location, and the traction end location is an example of a second location.

For example, when a train 1 on the main line is to be drawn to the storage location by a train-moving machine 8, the traction start location refers to the location of the boundary region between an end section of the main line where the train 1 is parked and an entry-exit of the rail yard 2, and the traction end location refers to the location of the train-moving machine 8 when the train 1 will have been moved to the storage location.

Alternatively, when a train 1 at the storage location is to be drawn to an end section of the main line by a train-moving machine 8, the traction start location refers to the location where the train-moving machine 8 can couple with the train 1 at the storage location, and the traction end location refers to the location of the boundary region between the end section of the main line and an entry-exit of the rail yard 2. The location of the boundary region between an end section of the main line and an entry-exit of the rail yard 2 may be hereinafter referred to as boundary location.

Still alternatively, when a train 1 at the storage location is to be drawn to a washing track or to the inspection and repair shop 5 by a train-moving machine 8, the first location is the location where the train-moving machine 8 can couple with the train 1 located at the storage location, and the second location is the location of the train-moving machine 8 when the train 1 will have been moved to a washing track or to the inspection and repair shop 5.

As described above, the rail yard train-switching system 100 enables each of the train-moving machines 8 to draw a train 1 based on the traction command from the control device 7, thereby enabling a reduction or elimination of human error as compared to when a motorman operates the train-moving machine 8 to perform, or an operator remotely controls, switching of a train 1. Thus, the rail yard train-switching system 100 reduces or eliminates operational errors each caused by a human error, thereby enabling a switching operation of a train 1 to be efficiently performed in the rail yard 2. The rail yard train-switching system 100 also eliminates the need for operation of a train-moving machine by a qualified person permitted to operate the train-moving machine unlike a conventional system, and merely requires to monitor switching of the multiple trains 1 by a reduced number of personnel, thereby enabling a reduction in the number of qualified persons in the rail yard 2. The rail yard train-switching system 100 further eliminates the need for installation of an automatic train operation (ATO) on the trains 1. A switching operation of a train 1 may be hereinafter referred to simply as switching.

Figure 2:
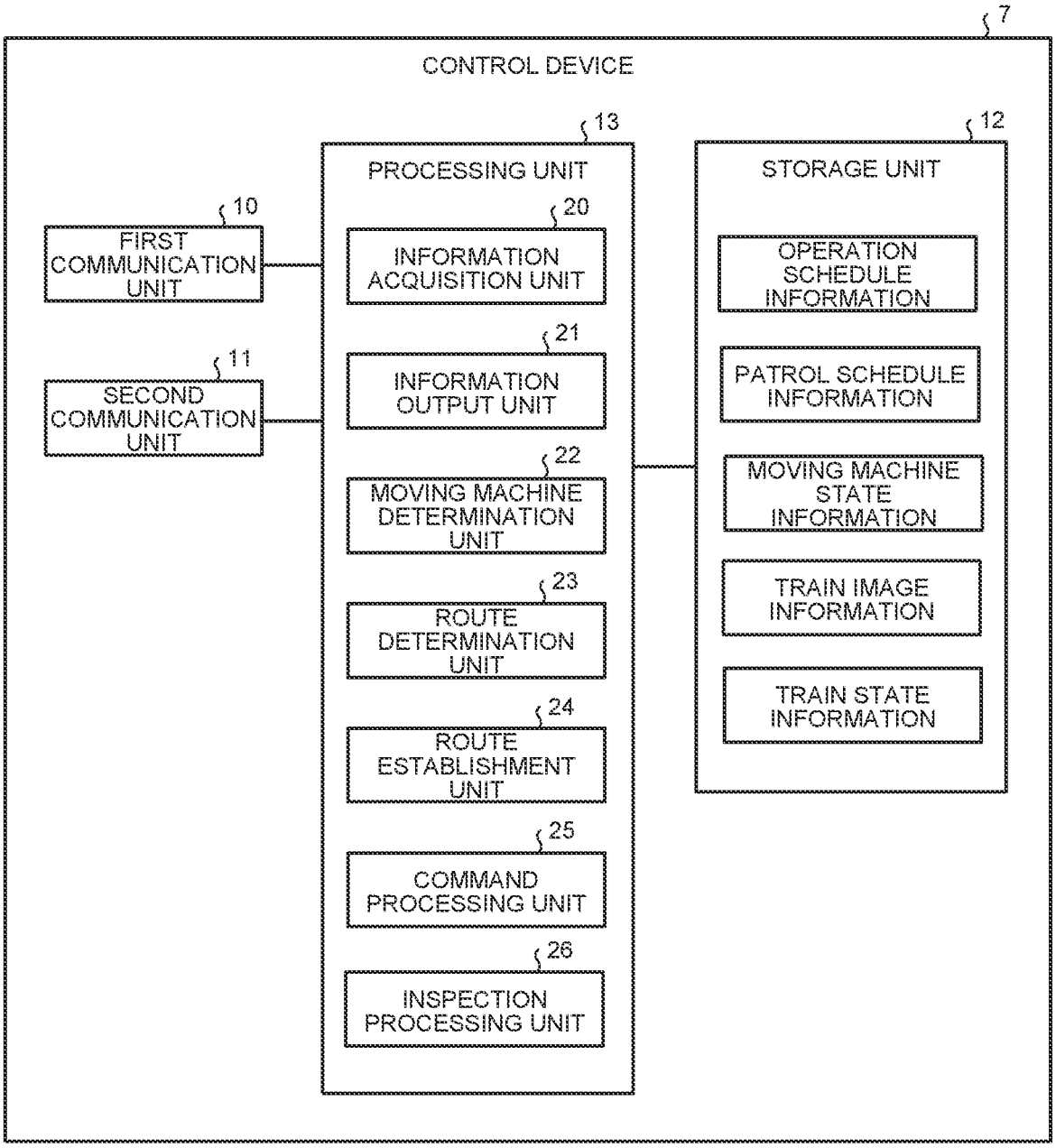
FIG. 2 is a diagram illustrating an example of configuration of the control device according to the first embodiment.

A configuration of each of the control device 7 and the train-moving machine 8 included in the rail yard train-switching system 100 will now be specifically described below. FIG. 2 is a diagram illustrating an example of configuration of the control device according to the first embodiment. As illustrated in FIG. 2, the control device 7 includes a first communication unit 10, a second communication unit 11, a storage unit 12, and a processing unit 13.

The first communication unit 10 is communicatively connected to the coordinator device 6 and to the monitor terminal 91 by wire or wirelessly via a network such as a local area network (LAN) or a wide area network (WAN), or via a dedicated line. The second communication unit 11 is communicatively connected to the train-moving machines 8 wirelessly via a wireless telephone communication network, a wide area communication network, or the like. Note that the second communication unit 11 may be communicatively connected to the train-moving machines 8 wirelessly via a wireless LAN.

The storage unit 12 stores operation schedule information, patrol schedule information, moving machine state information, train image information, train state information, and the like. The operation schedule information includes information of a schedule of switching of each of the trains 1. FIG. 3 is a diagram illustrating an example of operation schedule information according to the first embodiment.

The operation schedule information illustrated in FIG. 3 is information including, on a switching-by-switching basis, information about each of an "operation identifier (ID)", a "start time", an "operated train", a "traction start location", and a "traction end location". The "operation ID" is identification information unique to each switching operation. The "start time" is information representing the start time of switching. The "operated train" is information of the train 1 to be switched, and includes information such as, for example, the train unit name of the train 1 or the train number of the train 1.

The "traction start location" is information representing the location to make an applicable train-moving machine 8 start traction of a train 1. For example, when a train 1 on the main line is to be drawn to the storage location by an applicable train-moving machine 8, the "traction start location" is information representing the boundary location, which is the location of the boundary region between an end section of the main line where the train 1 is parked and an entry-exit of the rail yard 2.

The "traction end location" is information representing the location to make the train-moving machine 8 terminate the traction of the train 1. For example, when a train 1 on the main line is to be drawn to the storage location by the train-moving machine 8, the "traction end location" is the location of the train-moving machine 8 that will have drawn the train 1 to the storage location. The storage location is, for example, an inspection location, a cleaning location, a replacement location, or a grinding location. The inspection location is a storage location for inspection. The cleaning location is a storage location for cleaning, where a washer or a cleaner is provided. The replacement location is a storage location for replacement of a component included in the train 1.

Referring back to FIG. 2, the description of the storage unit 12 will be continued. The patrol schedule information stored in the storage unit 12 is information of a patrol schedule of each of the train-moving machines 8 in the rail yard 2, and includes, for example, information of the travel route and the movement time of each of the train-moving machines 8. The movement time of each of the train-moving machines 8 included in the patrol schedule information is set to, for example, a time during hours in which no switching is performed.

The moving machine state information includes state information that is information representing the state of each of the train-moving machines 8. The train image information includes information of captured images of the trains 1, and is used for inspection. The train image information includes information of captured images of the trains 1 in a normal condition. The train state information includes state information that is information representing the state of each of the trains 1. The state information of a train 1 is information representing the state of that train 1 detected by a train-moving machine 8.

The processing unit 13 includes an information acquisition unit 20, an information output unit 21, a moving machine determination unit 22, a route determination unit 23, a route establishment unit 24, a command processing unit 25, and an inspection processing unit 26. The information acquisition unit 20 obtains, from the first communication unit 10, the state information wirelessly transmitted from each of the train-moving machines 8 and received by the second communication unit 11. The information acquisition unit 20 stores the state information of each of the train-moving machines 8 obtained, in the storage unit 12.

The state information of each of the train-moving machines 8 includes information such as information representing the current location of the train-moving machine 8, information representing whether the train-moving machine 8 is in operation or not, information representing the travel distance of the train-moving machine 8, information representing the operation time of the train-moving machine 8, information representing the remaining capacity of the train-moving machine 8, and information representing the state of each on-board device provided in the train-moving machine 8. The state in which a train-moving machine 8 is not in operation may be hereinafter referred to as idle state.

The travel distance of a train-moving machine 8 is the distance the train-moving machine 8 has moved, and is, for example, a total travel distance or a travel distance in a unit time period of that train-moving machine 8. The operation time of a train-moving machine 8 is the time spent by that train-moving machine 8 in switching, and is for example, is a total time spent by that train-moving machine 8 in switching or a time spent in a unit time period by that train-moving machine 8 in switching. The unit time period is, for example, one day, one week, or one month.

The remaining capacity of a train-moving machine 8 is a remaining battery capacity in a case in which the train-moving machine 8 is battery-operated, and is a remaining amount of fuel in a case in which the train-moving machine 8 is fuel-operated. The state of each on-board device provided in a train-moving machine 8 is, for example, information representing whether the each on-board device is in operation or not, information representing whether the each on-board device is operating normally or not normally, and/or the like.

Note that the state information of each of the train-moving machines 8 includes information representing the progress of switching being performed by that train-moving machine 8 when the train-moving machine 8 is in operation. The progress of switching includes, for example, the degree of progress of switching and/or the like.

The information acquisition unit 20 also obtains, from the second communication unit 11, the state information of each of the trains 1 wirelessly transmitted from each corresponding one of the train-moving machines 8 and received by the second communication unit 11. The information acquisition unit 20 stores the state information of each of the trains 1 obtained, in the storage unit 12. The state information of a train 1 is information representing the state of that train 1 detected by the train-moving machine 8, and includes, for example, information of a captured image of that train 1.

The information output unit 21 generates a monitor image that meets a request transmitted from the monitor terminal 91 by an operation of the operator and received by the first communication unit 10. The information output unit 21 causes the first communication unit 10 to transmit information of the monitor image generated, to the monitor terminal 91. For example, the information output unit 21 generates, based on information stored in the storage unit 12, a monitor image including an image indicating the locations of the trains 1 and of the train-moving machines 8 in the rail yard 2, and causes the first communication unit 10 to transmit the information of the monitor image generated, to the monitor terminal 91.

FIG. 4 is a diagram illustrating an example of monitor image displayed on the monitor terminal in the central control room according to the first embodiment. A monitor image 80 illustrated in FIG. 4 is an image including images of the respective trains 1 and images of the respective train-moving machines 8 superimposed on a layout image of the rail yard 2. The monitor image 80 illustrated in FIG. 4 enables the operator of the central control room 9 to readily understand the states of the trains 1 and of the train-moving machines 8. Note that the monitor image 80 may include identification information of each of the trains 1, identification information of each of the train-moving machines 8, information representing whether each of the train-moving machines 8 is performing switching, and the like.

The information output unit 21 illustrated in FIG. 2 also generates an operation schedule management image that meets a request transmitted from the monitor terminal 91 by an operation of the operator and received by the first communication unit 10. The information output unit 21 causes the first communication unit 10 to transmit information of the operation schedule management image generated, to the monitor terminal 91.

Figures 5, 6:
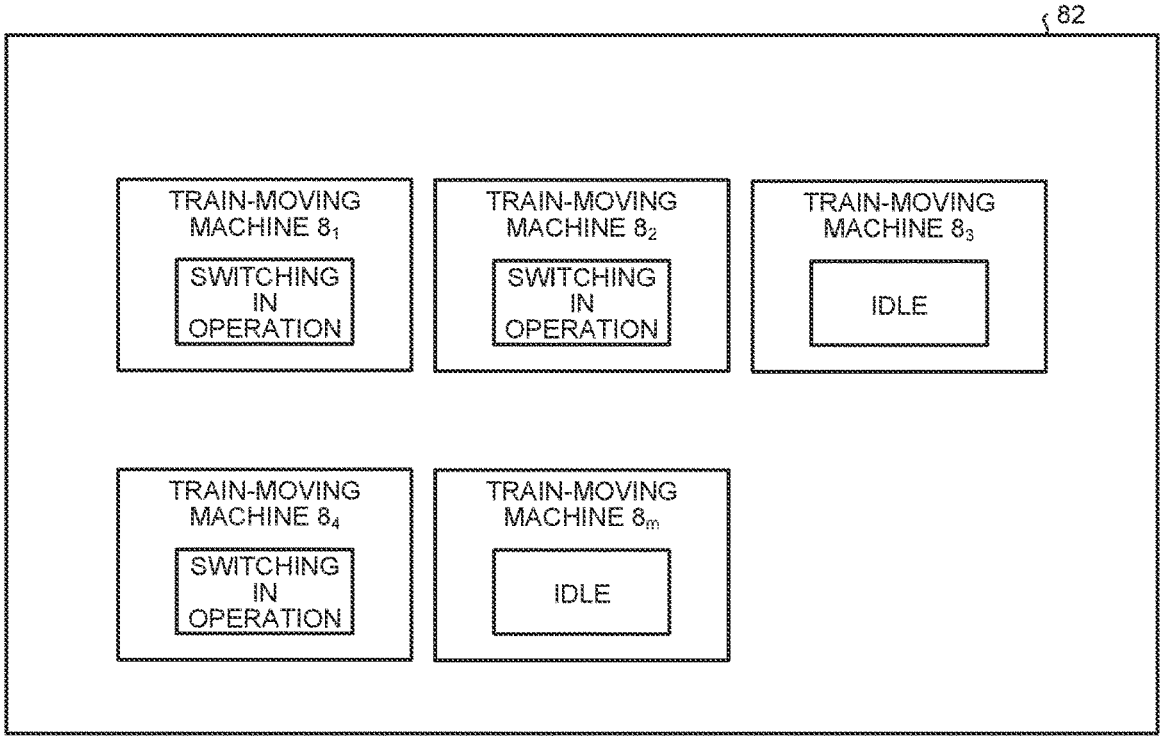
FIG. 5 is a diagram illustrating an example of operation schedule management image displayed on the monitor terminal in the central control room according to the first embodiment.
FIG. 6 is a diagram illustrating another example of the monitor image displayed on the monitor terminal in the central control room according to the first embodiment.

FIG. 5 is a diagram illustrating an example of operation schedule management image displayed on the monitor terminal in the central control room according to the first embodiment. An operation schedule management image 81 illustrated in FIG. 5 enables the operator of the central control room 9 to understand the schedule of switching. Note that the operation schedule management image 81 may include, for example, information representing a status of each switching operation. The information representing a status of switching operation is, for example, information representing whether that switching operation is complete, information representing whether that switching operation is in process, or the like.

In addition, the operator of the central control room 9 can also change an operation schedule, which is the schedule of switching, through operation on the monitor terminal 91. The monitor terminal 91 is capable of transmitting information of the operation schedule resulting from changing by the operator to the control device 7 as the operation schedule information. The information acquisition unit 20 of the control device 7 is capable of storing the operation schedule information transmitted from the monitor terminal 91 and received by the first communication unit 10, in the storage unit 12. The operation schedule information stored in the storage unit 12 is thus updated.

The information output unit 21 illustrated in FIG. 2 is also capable of generating a monitor image indicating the states of the respective train-moving machines 8 as the monitor image that meets a request transmitted from the monitor terminal 91 by an operation of the operator and received by the first communication unit 10. FIG. 6 is a diagram illustrating another example of the monitor image displayed on the monitor terminal in the central control room according to the first embodiment. A monitor image 82 illustrated in FIG. 6 includes images indicating the states of the respective train-moving machines $\mathbf{8}_1$, $\mathbf{8}_2$, $\mathbf{8}_3$, $\mathbf{8}_4$, and $\mathbf{8}_m$. The monitor image 82 includes information representing whether each of the train-moving machines 8 is performing switching, as the image indicating the state of each of the train-moving machines 8.

Note that the monitor image 82 may include information representing in detail the state of each of the train-moving machines 8 as the image indicating the state of each of the train-moving machines 8 in addition to, or in place of, information representing whether the train-moving machine 8 is performing switching. The information representing in detail the state of each of the train-moving machines 8 is information including, for example, at least one of information representing the current location of the train-moving machine 8, information representing the travel distance of the train-moving machine 8, information representing the operation time of the train-moving machine 8, information representing the remaining capacity of the train-moving machine 8, and information representing the state of each on-board device in the train-moving machine 8. The information output unit 21 is also capable of generating, instead of the monitor image 82, a monitor image including the information representing in detail the states of ones of the train-moving machines 8 selected from the train-moving machines 8 included in the monitor image 82 illustrated in FIG. 6, and causing the first communication unit 10 to transmit the information of the monitor image generated, to the monitor terminal 91.

Figure 7:
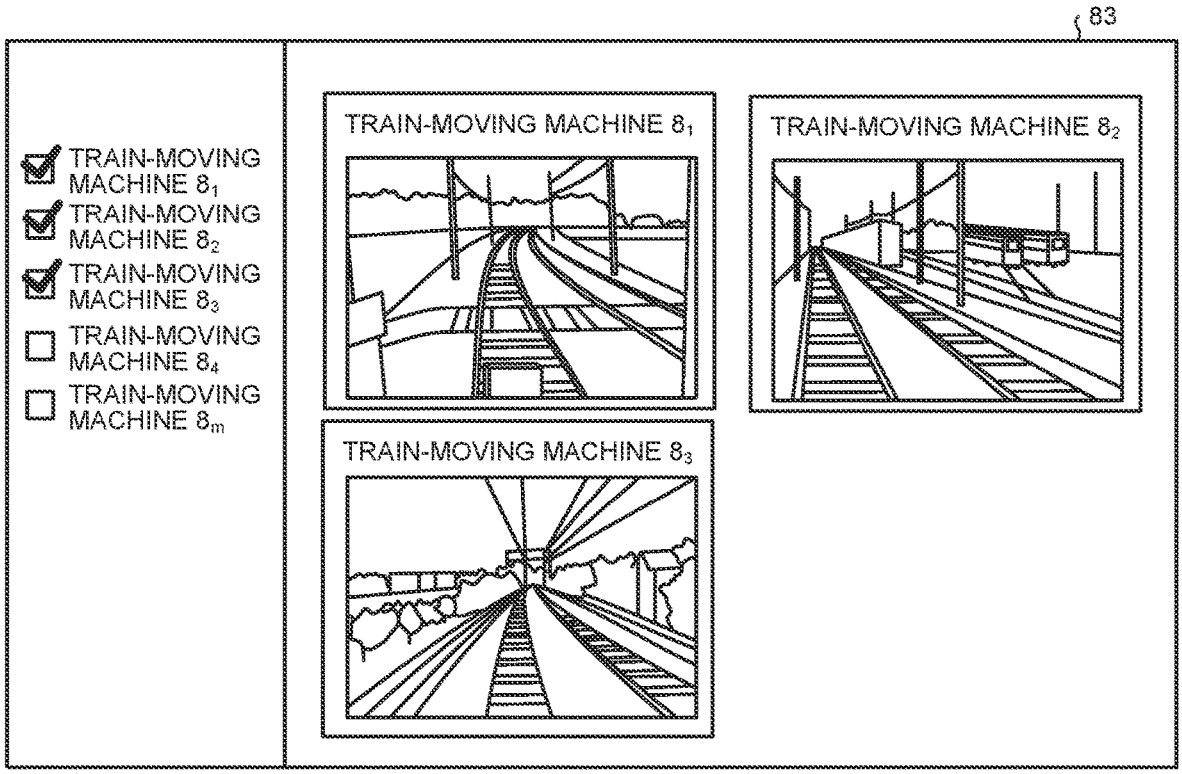
FIG. 7 is a diagram illustrating still another example of the monitor image displayed on the monitor terminal in the central control room according to the first embodiment.

The information output unit 21 illustrated in FIG. 2 is further capable of generating a monitor image including an image captured by an image sensor of each of the train-moving machines 8, as the monitor image that meets a request transmitted from the monitor terminal 91 by an operation of the operator and received by the first communication unit 10. FIG. 7 is a diagram illustrating still another example of the monitor image displayed on the monitor terminal in the central control room according to the first embodiment. A monitor image 83 illustrated in FIG. 7 includes front view images captured by the image sensors of the respective train-moving machines $\mathbf{8}_1$, $\mathbf{8}_2$, and $\mathbf{8}_3$ selected from the train-moving machines $\mathbf{8}_1$, $\mathbf{8}_2$, $\mathbf{8}_3$, $\mathbf{8}_4$, and $\mathbf{8}_m$.

The information output unit 21 illustrated in FIG. 2 is still further capable of generating a monitor image including an image of an intruder or of an intruding existence into the rail yard 2, detected by one of the train-moving machines 8 patrolling the rail yard 2, and causing the first communication unit 10 to transmit information of the monitor image generated, to the monitor terminal 91.

As described above, the information output unit 21 is capable of causing the first communication unit 10 to transmit, to the monitor terminal 91, an image that meets a request transmitted from the monitor terminal 91 by an operation of the operator and received by the first communication unit 10. This enables the operator of the central control room 9 to readily understand the state of the rail yard 2, the states of the respective trains 1, and the states of the respective train-moving machines 8.

Note that the information output unit 21 in each of the foregoing examples transmits the corresponding one of the monitor images 80, 82, and 83 and the operation schedule management image 81 to the monitor terminal 91, but the information output unit 21 is also capable of transmitting, to the monitor terminal 91, image-generating information for generating the monitor images 80, 82, and 83 and the operation schedule management image 81. In this case, the monitor terminal 91 generates the monitor images 80, 82, and 83 and the operation schedule management image 81 based on the image-generating information, and displays the monitor images 80, 82, and 83 and the operation schedule management image 81 generated.

The operator of the central control room 9 can also operate the monitor terminal 91 to cause the monitor terminal 91 to transmit various commands such as a traction command for each of the train-moving machines 8, to the control device 7. When a command from the monitor terminal 91 is received by the first communication unit 10, the information acquisition unit 20 obtains, from the first communication unit 10, the command from the monitor terminal 91, and notifies the command obtained, to the information output unit 21. The information output unit 21 causes the second communication unit 11 to transmit the command from the monitor terminal 91 to the applicable one or ones of the train-moving machines 8. This enables the operator to remotely operate the train-moving machines 8, for example, in case of emergency or the like.

The moving machine determination unit 22 illustrated in FIG. 2 obtains the operation schedule information and the state information of each of the train-moving machines 8 from the storage unit 12. The moving machine determination unit 22 determines the train-moving machine 8 that is to perform a particular switching operation, based on the operation schedule information and on the state information of each of the train-moving machines 8 that have been obtained. For example, when one of the train-moving machines 8 is in an idle state, the moving machine determination unit 22 determines that the train-moving machine 8 in an idle state is the train-moving machine 8 that is to perform the switching.

In addition, when multiple ones of the train-moving machines 8 are in an idle state, the moving machine determination unit 22 determines that, of the multiple ones of the multiple train-moving machines 8 that are in an idle state, the train-moving machine 8 nearest to the traction start location of the switching is the train-moving machine 8 that is to perform the switching.

Assume here that the operation schedule information is as illustrated in FIG. 3, and the moving machine determination unit 22 is to determine the train-moving machine 8 that is to perform switching assigned the operation ID "O1". In this case, the moving machine determination unit 22 determines the train-moving machine 8 located nearest to the boundary location among the multiple train-moving machines 8 in an idle state to be the train-moving machine 8 that is to perform switching assigned the operation ID "O1".

The moving machine determination unit 22 is also capable of determining the train-moving machine 8 that is to perform switching to lead the travel distance or the operation time of that train-moving machine 8 to be close to the average value of the travel distances or the average value of the operation times of all the train-moving machines 8. The moving machine determination unit 22 is further capable of determining the train-moving machine 8 that is to perform switching, giving preference to a train-moving machine 8 having a high remaining capacity.

When multiple ones of the train-moving machines 8 are in an idle state, the moving machine determination unit 22 is also capable of determining, for example, the train-moving machine 8 having a lowest score Sc obtained by Equation (1) below to be the train-moving machine 8 that is to perform switching.

$$Sc=k1\times x1+k2\times x2+k3\times x3+k4\times x4 \quad (1)$$

In Equation (1) above, "k1", "k2", "k3", and "k4" are factors, and "x1", "x2", "x3," and "x4" are parameters for calculating the score Sc. These parameters can also be each called feature quantity. The parameter "x1" is a reaching distance, which is the distance from the location of the train-moving machine 8 for which the score Sc is being calculated to the traction start location of the switching. The parameter "x2" is the travel distance of the train-moving machine 8 for which the score Sc is being calculated. The parameter "x3" is the operation time of the train-moving machine 8 for which the score Sc is being calculated. The parameter "x4" is the reciprocal of the remaining capacity of the train-moving machine 8 for which the score Sc is being calculated. Note that one, two, or three of "k1", "k2", "k3", and "k4" may be zero.

Note that in Equation (1) above, the parameters "x1", "x2", "x3," and "x4" may be, respectively, the reciprocal of the reaching distance, the reciprocal of the travel distance of the train-moving machine 8, the reciprocal of the operation time of the train-moving machine 8, and the remaining capacity. In this case, the moving machine determination unit 22 determines the train-moving machine 8 having a highest score Sc to be the train-moving machine 8 that is to perform switching.

The moving machine determination unit 22 is capable of determining the train-moving machine 8 that is to perform switching based also on, for example, the state of each on-board device provided in that train-moving machine 8 as another parameter for calculating the score Sc, in addition to the reaching distance, the travel distance, the operation time, and the remaining capacity described above.

In addition, even when none of the train-moving machines 8 is in an idle state, the moving machine determination unit 22 is capable of determining the train-moving machine 8 that is to perform switching based on the score Sc. In this case, the moving machine determination unit 22 is capable of determining the train-moving machine 8 that is to perform switching using an equation, for example, further including the time period from the current time to the estimated switching completion time, as another parameter for calculating the score Sc, in addition to the parameters in Equation (1) above.

In addition, the moving machine determination unit 22 is also capable of causing multiple ones of the train-moving machines 8 to cooperate with each other to allow those multiple ones of the train-moving machines 8 to together draw a single train 1. In this case, the moving machine determination unit 22 determines the multiple ones of the train-moving machines 8 to be the train-moving machines 8 that are to perform switching in a manner similar to the manner described above. For example, when two of the train-moving machines 8 are to be assigned to a single train 1, the moving machine determination unit 22 determines the train-moving machine 8 having a lowest score Sc and the train-moving machine 8 having a second lowest score Sc to be the train-moving machines 8 that are to perform switching on a single train 1.

The route determination unit 23 obtains the operation schedule information from the storage unit 12, and obtains, from the storage unit 12, information of the current location of the train-moving machine 8 that is determined by the moving machine determination unit 22 to be the train-moving machine 8 that is to perform switching. The route determination unit 23 determines the travel route of the train-moving machine 8 that is to perform switching, based on the operation schedule information and on the information of the current location of the train-moving machine 8 obtained. The travel route determined by the route determination unit 23 includes a first travel route, which is from the current location of the train-moving machine 8 that is to perform switching to the traction start location, and a second travel route, which is from the traction start location to the traction end location.

Assume here that the operation schedule information is as illustrated in FIG. 3, and the moving machine determination unit 22 determines the train-moving machine 8 that is to perform switching assigned the operation ID "O1". In this case, the route determination unit 23 determines that a travel route from the current location of the train-moving machine 8 determined by the moving machine determination unit 22 to the boundary location is the first travel route. In addition, the route determination unit 23 determines that a travel route from the boundary location to the inspection location is the second travel route.

The route establishment unit 24 generates a switch command based on the travel route determined by the route determination unit 23, and causes the first communication unit 10 to transmit the switch command generated, to the coordinator device 6. The coordinator device 6 controls one or more of the switches 4 corresponding to this switch command based on the switch command from the route establishment unit 24. This causes the travel route determined by the route determination unit 23 to be established in the rail yard 2.

The route establishment unit 24 also generates a switch command during hours such as nighttime in which no switching is performed, based on information of the travel routes of the respective train-moving machines 8 included in the patrol schedule information, and causes the first communication unit 10 to transmit the switch command generated, to the coordinator device 6. The coordinator device 6 controls one or more of the switches 4 corresponding to this switch command based on the switch command from the route establishment unit 24. This causes a travel route following the patrol schedule information to be established in the rail yard 2. Note that in a case in which the first travel route and the second travel route fail to be simultaneously established, the route establishment unit 24 causes the first communication unit 10 to transmit a switch command in accordance with the second travel route to the coordinator device 6 after the second travel route becomes ready to be established, or after the train-moving machine 8 has traveled the first travel route.

The command processing unit 25 causes the second communication unit 11 to transmit a traction command to the train-moving machine 8 that has been determined, by the moving machine determination unit 22, to be the train-moving machine 8 that is to perform switching. A traction command includes information of each of the traction start location, the traction end location, the travel route determined by the route determination unit 23, and the like. A traction command also includes information of a waiting location of the train-moving machine 8 after performing the switching.

The train-moving machine 8 moves, based on the traction command transmitted from the control device 7, to the traction start location specified by the traction command, couples with the train 1, and draws the train 1 from the traction start location to the traction end location.

In addition, when the moving machine determination unit 22 determines that multiple ones of the train-moving machines 8 are to together perform switching of a single train 1, the command processing unit 25 causes the second communication unit 11 to transmit a traction command to each of these multiple ones of the train-moving machines 8.

Moreover, the command processing unit 25 causes the second communication unit 11 to transmit an entry prohibition command, which prohibits the train-moving machines 8 other than the train-moving machine 8 that receives the traction command, among the multiple train-moving machines 8, from entering the travel route of the train-moving machine 8 that is to perform switching. This enables the rail yard train-switching system 100 to prevent a train-moving machine 8 other than the train-moving machine 8 that is to perform switching from entering the travel route of the train-moving machine 8 that is to perform switching.

The command processing unit 25 causes the second communication unit 11 to transmit a patrol command to each applicable one of the train-moving machines 8 during hours such as nighttime in which no switching is performed, based on information of the travel route and of the movement time of each of the train-moving machines 8 included in the patrol schedule information. Each of the train-moving machines 8 performs a patrol operation in the rail yard 2 based on the patrol command transmitted from the control device 7. Such patrol operation is a patrol operation for detecting an intrusion to be detected into the rail yard 2. The train-moving machine 8 patrols the rail yard 2 while performing a process of detecting the presence or absence of an intrusion to be detected. The train-moving machine 8 wirelessly transmits a result of detection of an intrusion to be detected to the control device 7.

The inspection processing unit 26 is capable of inspecting a train 1 based on the train state information of that train 1 transmitted from the corresponding one of the train-moving machines 8. For example, the inspection processing unit 26 is capable of detecting an anomaly such as damage or deformation of a train 1 based on a result of comparison between the train image information stored in the storage unit 12 and information of a captured image of that train 1 transmitted from the train-moving machine 8. The inspection processing unit 26 is also capable of causing the second communication unit 11 to transmit the train image information stored in the storage unit 12 to the train-moving machine 8 to allow the train-moving machine 8 to inspect the applicable train 1.

Figure 8:
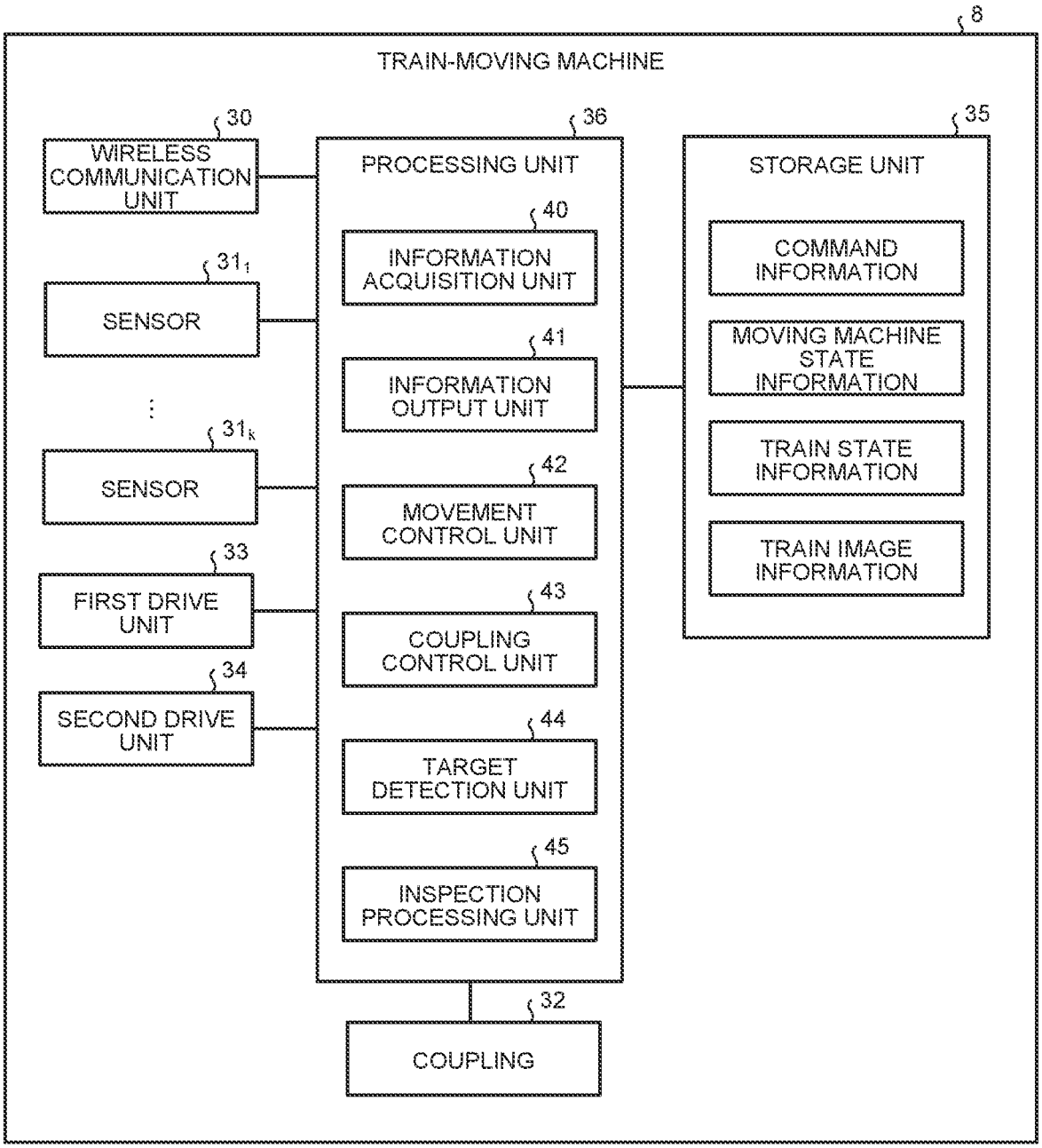
FIG. 8 is a diagram illustrating an example of configuration of the train-moving machine according to the first embodiment.

A configuration of the train-moving machine 8 will next be described. FIG. 8 is a diagram illustrating an example of configuration of the train-moving machine according to the first embodiment. As illustrated in FIG. 8, the train-moving machine 8 includes a wireless communication unit 30, multiple sensors $\mathbf{31}_1$ to $\mathbf{31}_k$, a coupling 32, a first drive unit 33, a second drive unit 34, a storage unit 35, and a processing unit 36, where k is an integer greater than or equal to 2.

The wireless communication unit 30 transmits and receives information to and from the control device 7 using wireless communication via a wireless base station of a wireless telephone communication network or via a wireless base station of a wide area communication network. The sensors $\mathbf{31}_1$ to $\mathbf{31}_k$ are each, for example, a position sensor that calculates the current location of the train-moving machine 8, an obstacle sensor that detects an obstacle around the train-moving machine 8, an image sensor that captures an image of surroundings of the train-moving machine 8, a speed sensor that detects the moving speed of the train-moving machine 8, a sensor that detects a radio frequency identification (RFID) tag or a quick response (QR) code (registered trademark), or the like. Note that one of the multiple sensors $\mathbf{31}_1$ to $\mathbf{31}_k$ may be a sensor that detects a bar code rather than a sensor that detects a two-dimensional code such as a QR code.

A position sensor receives a positioning signal from, for example, a positioning satellite such as a global positioning system (GPS) satellite, and calculates the current location of the train-moving machine 8 based on the positioning signal received. The multiple sensors $\mathbf{31}_1$ to $\mathbf{31}_k$ may each be referred to hereinafter as sensor 31 when no distinction is made.

The coupling 32 is a coupling to be coupled with the coupling of a train 1. The train-moving machine 8 approaches a train 1, and presses the coupling 32 onto the coupling of that train 1 thus to allow the coupling 32 to be coupled with the coupling of the train 1.

The first drive unit 33 includes multiple wheels that roll on the track 3, and a drive source for rotating at least one or some of these multiple wheels. In addition, the second drive unit 34 includes multiple tires, a drive source for rotating at least one or some of these multiple tires, and a moving mechanism. In the case in which the train-moving machine 8 is battery-operated, the drive sources of the first drive unit 33 and of the second drive unit 34 are each a motor. In the case in which the train-moving machine 8 is fuel-operated, the drive sources of the first drive unit 33 and of the second drive unit 34 are each an engine.

When the train-moving machine 8 rests on the track 3, the moving mechanism of the second drive unit 34 moves the multiple wheels off of the track 3, and moves the train-moving machine 8 transversely. This allows the train-moving machine 8 to travel in an area off the track 3 using the multiple tires. The transverse direction is a direction perpendicular to the direction in which the track 3 extends. Conversely, when the train-moving machine 8 rests in an area off the track 3, the moving mechanism of the second drive unit 34 is capable of moving the multiple tires off of the area off the track 3, and transversely moving the train-moving machine 8 to place the multiple wheels on the track 3.

The storage unit 35 stores command information, moving machine state information, train state information, train image information, and the like. The command information includes information of a traction command transmitted from the control device 7, information of a patrol command, information of an entry prohibition command, or the like. The moving machine state information is the foregoing state information of the train-moving machine 8, and is detected by one or some of the multiple sensors 31. The train state information is the foregoing state information of each applicable train 1, and is detected by one or some of the multiple sensors 31. The train image information is information of a captured image of a train 1 in a normal condition.

The processing unit 36 includes an information acquisition unit 40, an information output unit 41, a movement control unit 42, a coupling control unit 43, a target detection unit 44, and an inspection processing unit 45. The information acquisition unit 40 obtains information transmitted from the control device 7 and received by the wireless communication unit 30, and stores the information obtained, in the storage unit 35. The information acquisition unit 40 also obtains the moving machine state information and the train state information from the multiple sensors 31, and stores the moving machine state information and the train state information obtained, in the storage unit 35. The information output unit 41 causes the wireless communication unit 30 to transmit the moving machine state information and the train state information stored in the storage unit 35 to the control device 7.

The movement control unit 42 operates the first drive unit 33 based on the command information obtained by the information acquisition unit 40 to cause the train-moving machine 8 to move. For example, when the command information obtained by the information acquisition unit 40 is information of a traction command, the movement control unit 42 controls the first drive unit 33 to move the train-moving machine 8 along the first travel route specified by the traction command from the current location to the traction start location specified by the traction command, and at the traction start location, causes the coupling 32 of the train-moving machine 8 to couple with the coupling of the train 1. The movement control unit 42 then controls the first drive unit 33 to move the train-moving machine 8 along the second travel route specified by the traction command from the traction start location to the traction end location specified by the traction command.

The rail yard 2 has, for example, an RFID tag, a QR code, or the like provided at each traction start location and at each traction end location. When the sensor 31 detects an RFID tag or a QR code corresponding to the traction start location, the movement control unit 42 detects that the train-moving machine 8 has reached the traction start location or vicinity of the traction start location. In addition, when the sensor 31 detects an RFID tag or a QR code corresponding to the traction end location, the movement control unit 42 detects that the train-moving machine 8 has reached the traction end location or vicinity of the traction end location. Moreover, the movement control unit 42 is also capable of detecting that the train-moving machine 8 has reached the traction start location, the traction end location, vicinity of the traction start location, or vicinity of the traction end location based on the location detected by a position sensor among the multiple sensors 31 instead of using RFID tag or QR code detection. Note that an RFID tag or a QR code may be provided in vicinity of the traction start location or in vicinity of the traction end location.

Figure 9:
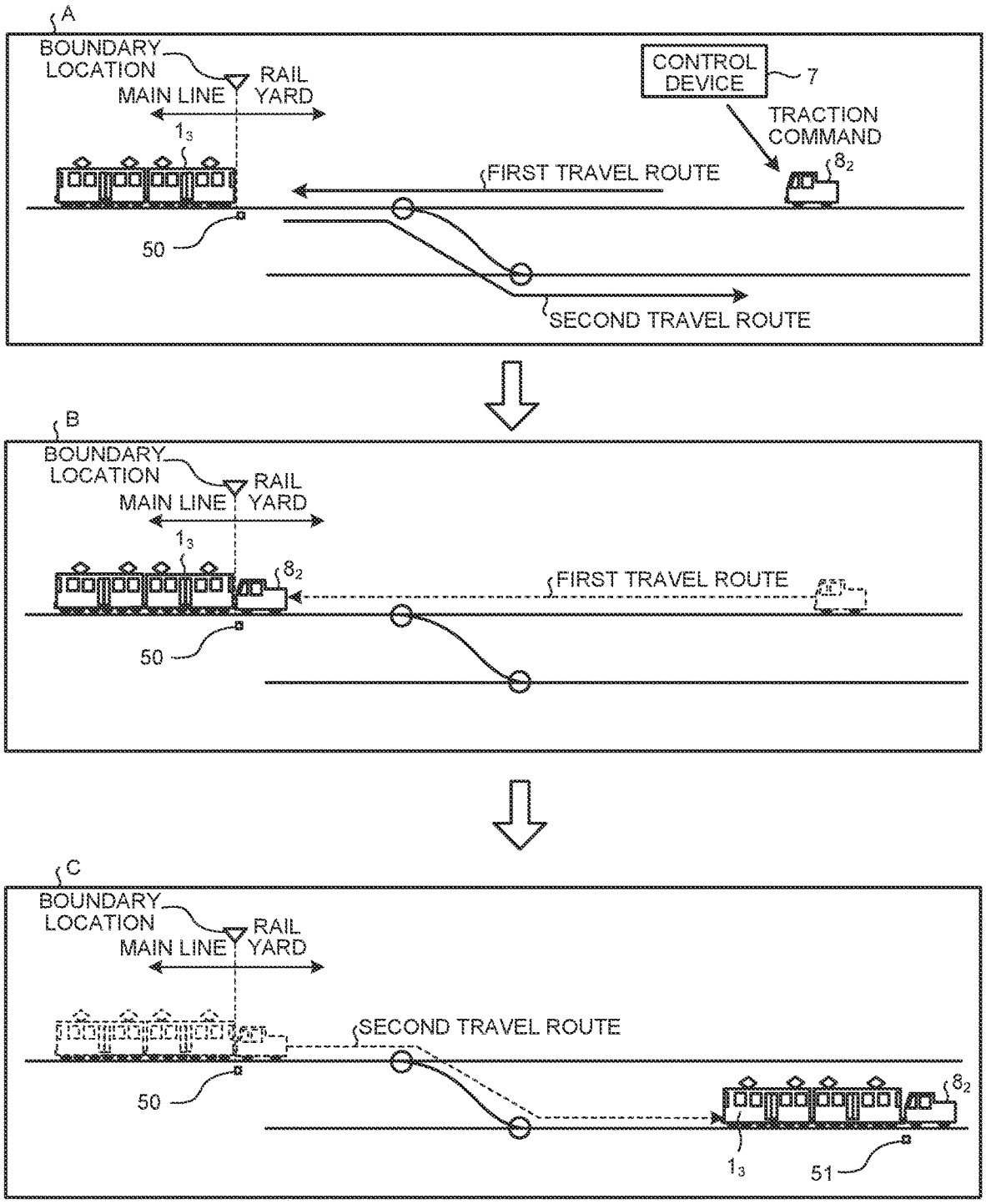
FIG. 9 is a diagram illustrating an example of procedure of train traction performed by the train-moving machine according to the first embodiment.

FIG. 9 is a diagram illustrating an example of procedure of train traction performed by the train-moving machine according to the first embodiment. As illustrated in panel A of FIG. 9, the control device 7 transmits a traction command to the train-moving machine $\mathbf{8}_2$ when the control device 7 determines that the train-moving machine $\mathbf{8}_2$ is the train-moving machine 8 that is to draw the train $\mathbf{1}_3$. Such traction command includes information of each of the traction start location, the traction end location, the first travel route, the second travel route, and the waiting location.

Upon reception of the traction command from the control device 7, the train-moving machine $\mathbf{8}_2$ moves along the first travel route specified by the traction command from the current location to the traction start location specified by the traction command as illustrated in panel B of FIG. 9.

A QR code 50 is provided at the traction start location, and upon detection of the QR code 50, the train-moving machine $\mathbf{8}_2$ temporarily stops, then approaches the train $\mathbf{1}_3$, and presses the coupling 32 to the coupling of the train $\mathbf{1}_3$ to couple with the train $\mathbf{1}_3$. This allows the train-moving machine $\mathbf{8}_2$ to couple with the train $\mathbf{1}_3$ at the traction start location.

The train-moving machine $\mathbf{8}_2$ next moves along the second travel route specified by the traction command from the traction start location to the traction end location specified by the traction command as illustrated in panel C of FIG. 9. A QR code 51 is provided at the traction end location, and upon detection of the QR code 51, the train-moving machine $\mathbf{8}_2$ stops moving and decouples the train $\mathbf{1}_3$. The train-moving machine $\mathbf{8}_2$ then moves to the waiting location.

Switching of a train 1 may also be performed by multiple ones of the train-moving machines 8 in conjunction. In this case, the control device 7 transmits a traction command to each of the multiple ones of the train-moving machines 8. The multiple ones of the train-moving machines 8 draw the train 1 in conjunction with each other based on the respective traction commands transmitted from the control device 7.

Figure 10:
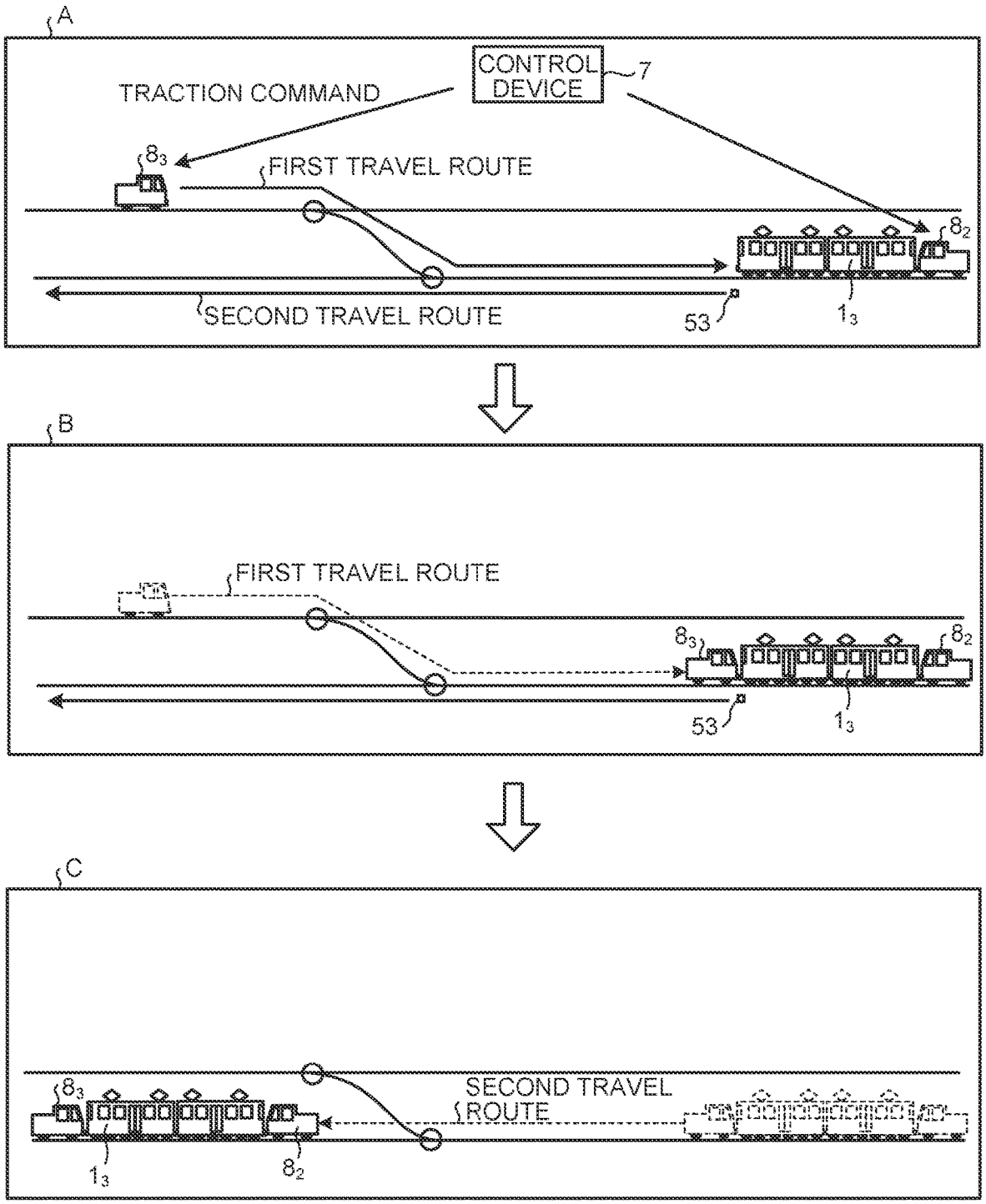
FIG. 10 is a diagram illustrating another example of the procedure of train traction performed by the train-moving machine according to the first embodiment.

FIG. 10 is a diagram illustrating another example of procedure of train traction performed by the train-moving machine according to the first embodiment. As illustrated in panel A of FIG. 10, the control device 7 transmits a traction command to the train-moving machines $\mathbf{8}_2$ and $\mathbf{8}_3$ when the control device 7 determines that the train-moving machines $\mathbf{8}_2$ and $\mathbf{8}_3$ are each the train-moving machine that is to draw the train $\mathbf{1}_3$.

The traction command for each of the train-moving machines $\mathbf{8}_2$ and $\mathbf{8}_3$ includes information of each of the traction start location, the traction end location, the travel route, and the waiting location. In the traction command for the train-moving machine $\mathbf{8}_2$, the traction start location is the current location, and the travel route is the second travel route illustrated in panel A of FIG. 10. In addition, in the traction command for the train-moving machine $\mathbf{8}_3$, the travel route is a combination of the first travel route and the second travel route illustrated in panel A of FIG. 10.

Upon reception of the traction command from the control device 7, the train-moving machine $\mathbf{8}_3$ moves along the first travel route specified by the traction command from the current location to the traction start location specified by the traction command as illustrated in panel B of FIG. 10.

A QR code 53 is provided at the traction start location, and upon detection of the QR code 53, the train-moving machine $\mathbf{8}_3$ temporarily stops, then approaches the train $\mathbf{1}_3$, and presses the coupling 32 to the coupling of the train $\mathbf{1}_3$ to couple with the train $\mathbf{1}_3$. This allows the train-moving machine $\mathbf{8}_3$ to couple with the train $\mathbf{1}_3$ at the traction start location.

The train-moving machines $\mathbf{8}_2$ and $\mathbf{8}_3$ next move along the second travel route specified by the traction command to the traction end location specified by the traction command as illustrated in panel C of FIG. 10. A QR code (not illustrated) is provided at the traction end location, and upon detection of the QR code (not illustrated), the train-moving machines $\mathbf{8}_2$ and $\mathbf{8}_3$ stop moving and decouple the train $\mathbf{1}_3$. The train-moving machines $\mathbf{8}_2$ and $\mathbf{8}_3$ then move to the waiting locations.

As described above, one or multiple train-moving machines 8 can draw the train 1 based on traction commands. Note that the location detection performed by the train-moving machine(s) 8 in FIGS. 9 and 10 is not limited to detection of a QR code, but may be detection of an RFID tag, or location detection based on a positioning signal from a positioning satellite.

A case may occur in which when the train-moving machine 8 arrives at the traction start location specified by the traction command under control of the movement control unit 42, the train 1 to be drawn is not present due to a travel delay or another cause. Upon determination that the train 1 to be drawn is not present, the information output unit 41 of the train-moving machine 8 causes the wireless communication unit 30 to transmit information indicating that the train 1 to be drawn is not present, to the control device 7. The processing unit 13 of the control device 7 is capable of changing the operation schedule information based on the information indicating that the train 1 to be drawn is not present. Note that the information output unit 41 is capable of determining whether the train 1 to be drawn is present based on an image captured at the traction start location by one of the sensors 31.

Upon reception, from the train-moving machine 8, of the information indicating that the train 1 to be drawn is not present, the processing unit 13 of the control device 7 queries a train traffic control system that manages the operation of the train 1 about the operational situation of the train 1. The processing unit 13 of the control device 7 is capable of changing the operation schedule information based on the operational situation of the train 1 notified by the train traffic control system. Note that the processing unit 13 of the control device 7 is also capable of periodically querying the train traffic control system about the operational situation of each of the trains 1, and then changing the operation schedule information based on the operational situation of each of the trains 1 that is periodically notified by the train traffic control system.

A case may also occur in which a train 1 different from the train 1 to be drawn is present when the train-moving machine 8 arrives at the traction start location specified by the traction command under control of the movement control unit 42. The information output unit 41 determines whether the train 1 at the traction start location is the train 1 to be drawn based on, for example, an image captured by a sensor 31. The traction command includes traction target information, which is information of the train 1 to be drawn, and a determination is thus made of whether the train 1 at the traction start location is the train 1 to be drawn by comparison of the traction target information with information obtained from an image captured by a sensor 31. When a train 1 different from the train 1 to be drawn is present, the information output unit 41 causes the wireless communication unit 30 to transmit information indicating that a train 1 different from the train 1 to be drawn is present at the traction start location, to the control device 7.

The processing unit 13 of the control device 7 is capable of changing the operation schedule information based on the information indicating that a train 1 different from the train 1 to be drawn is present. The processing unit 13 of the control device 7 changes the operation schedule information, as described above, based on the operational situation of the train 1 obtained from the train traffic control system that manages the operation of the train 1.

In addition, the train-moving machine 8 includes an image sensor for capturing a front view image of the train-moving machine 8 and an image sensor for capturing a rear view image of the train-moving machine 8, each as a sensor 31. The movement control unit 42 determines that a distance from another one of the train-moving machines 8 has fallen below a preconfigured distance based on a front view image and on a rear view image of the train-moving machine 8 output from these sensors 31.

Upon determination that the distance between the train-moving machine 8 being moved and another train-moving machine 8 has fallen below the preconfigured distance, the movement control unit 42 operates the first drive unit 33 to avoid a collision between the train-moving machine 8 being moved and another train-moving machine 8. This enables a collision between the train-moving machines 8 to be prevented.

The movement control unit 42 is also capable of transmitting and receiving information to and from another train-moving machine 8 via the wireless communication unit 30 to operate the first drive unit 33 to avoid a collision between the train-moving machines 8. For example, the movement control unit 42 is also capable of obtaining information about the current location of another train-moving machine 8 via the wireless communication unit 30 to operate the first drive unit 33 to avoid a collision between train-moving machines 8 based on the current location of the train-moving machine 8 being moved and on the current location of another train-moving machine 8.

After the train-moving machine 8 has moved to the traction end location, the coupling control unit 43 illustrated in FIG. 8 operates the coupling 32 to cause the coupling 32 of the train-moving machine 8 to decouple the coupling of the train 1. After the coupling control unit 43 has caused decoupling of the train 1, the movement control unit 42 operates at least one of the first drive unit 33 and the second drive unit 34 to move the train-moving machine 8. The train-moving machine 8 is moved to, for example, a predetermined location or the waiting location specified by the traction command.

In addition, when the command information obtained by the information acquisition unit 40 is information of a patrol command, the movement control unit 42 causes the train-moving machine 8 to move along a patrol route specified by the patrol command. In addition, when the information acquisition unit 40 receives information of an entry prohibition command while the train-moving machine 8 is moved based on a traction command or on a patrol command, the movement control unit 42 prevents the train-moving machine 8 from entering the travel route specified by the entry prohibition command.

When the train-moving machine 8 is patrolling the rail yard 2, the target detection unit 44 detects an intrusion to be detected into the rail yard 2 based on, for example, an image captured by an image sensor that is a sensor 31. The intrusion to be detected is an intrusion by an animal that has intruded into the rail yard 2, where the term animal includes a human being. For example, an intrusion to be detected is an intrusion by a human intruder into the rail yard 2 or an intrusion by an animal such as a fox or a raccoon dog that has intruded into the rail yard 2.

Note that the target detection unit 44 is also capable of detecting an intrusion to be detected into the rail yard 2 based on, for example, a result of detection performed by an infrared sensor or by a radar, each of which is a sensor 31. The target detection unit 44 is also capable of detecting an intrusion to be detected into the rail yard 2 based on results of detection performed by multiple ones of the sensors 31. For example, the target detection unit 44 is capable of detecting an intrusion to be detected into the rail yard 2 based on an image captured by an image sensor and on a result of detection performed by an infrared sensor.

Figure 11:
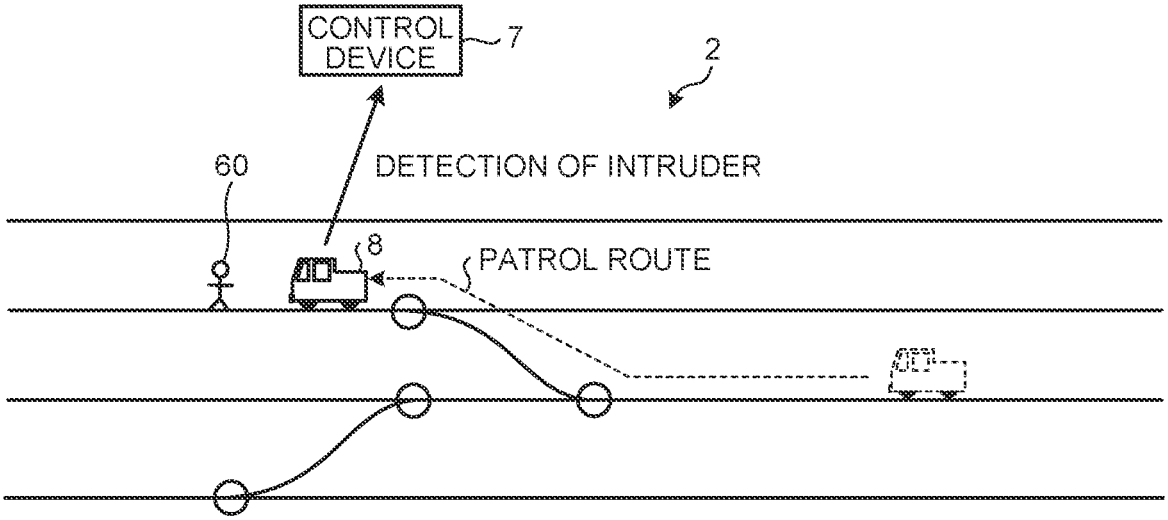
FIG. 11 is a diagram illustrating a process of detection of an intruder during patrol performed by the train-moving machine according to the first embodiment.

FIG. 11 is a diagram illustrating a process of detection of an intruder during patrol performed by the train-moving machine according to the first embodiment. As illustrated in FIG. 11, upon detection of an intruder 60 during traveling along the patrol route specified by the control device 7, the train-moving machine 8 transmits a detection result indicating that the intruder 60 has been detected, to the control device 7. The control device 7 notifies the result of detection of the intruder 60 by the train-moving machine 8 to the central control room 9. This enables the operator of the central control room 9 to know about the intruder 60 into the rail yard 2. Note that the train-moving machine 8 is also capable of transmitting, to the control device 7, a result of detection of the intruder 60 including an image of the intruder 60 captured by a sensor 31.

The inspection processing unit 45 illustrated in FIG. 8 is capable of inspecting a train 1 based on the train state information stored in the storage unit 35. The inspection processing unit 45 is capable of detecting an anomaly such as damage or deformation of a train 1 based on, for example, a result of comparison between an image represented by the train image information stored in the storage unit 35 and an image of the train 1 captured by a sensor 31 that is an image sensor.

Figure 12:
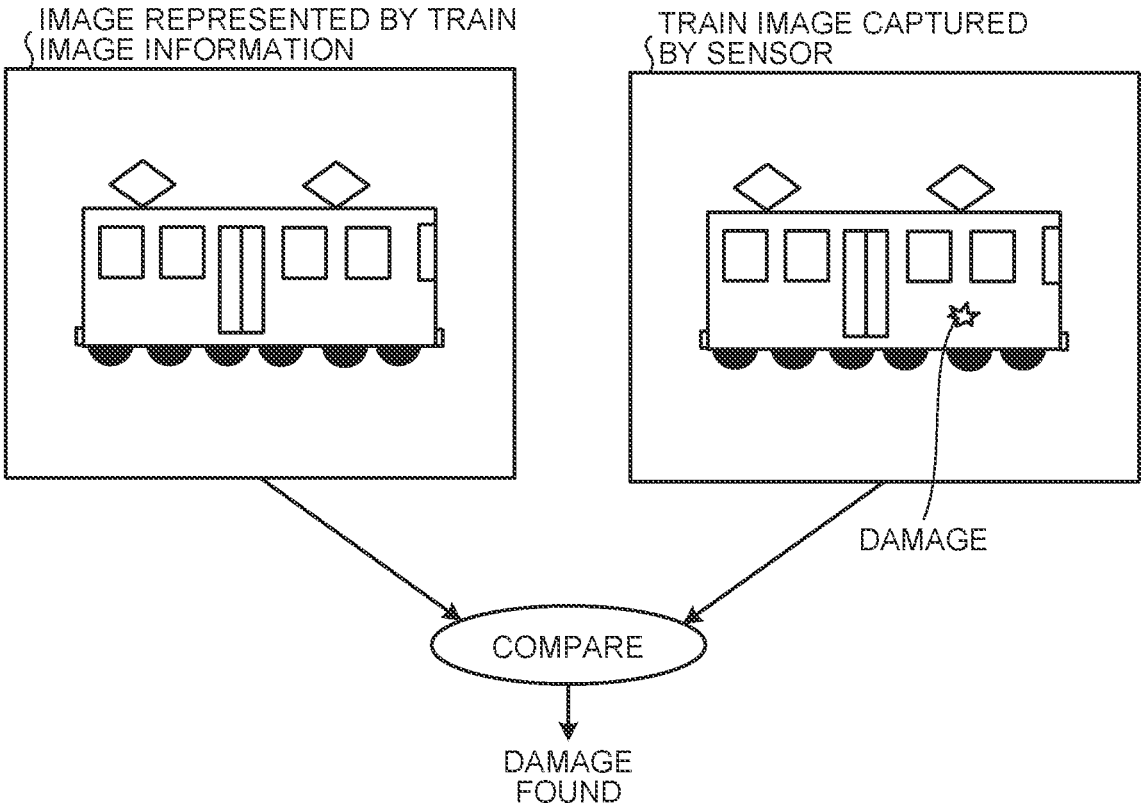
FIG. 12 is a diagram for describing an example of inspection method performed by the train-moving machine according to the first embodiment.

FIG. 12 is a diagram for describing an example of inspection method performed by the train-moving machine according to the first embodiment. As illustrated in FIG. 12, the inspection processing unit 45 compares an image represented by the train image information with an image of the train 1 captured by a sensor 31 that is an image sensor. The train 1 in the image captured by a sensor 31 has damage, which is unobserved in the image of the train 1 in a normal condition. Thus, the inspection processing unit 45 detects that the train 1 on inspection has damage.

Note that when the drive source of the train-moving machine 8 is a battery, and the remaining battery capacity detected by the sensor 31 is determined to be less than or equal to a threshold, the movement control unit 42 illustrated in FIG. 8 is also capable of moving the train-moving machine 8 to a charging station to charge the battery at the charging station.

Figure 13:
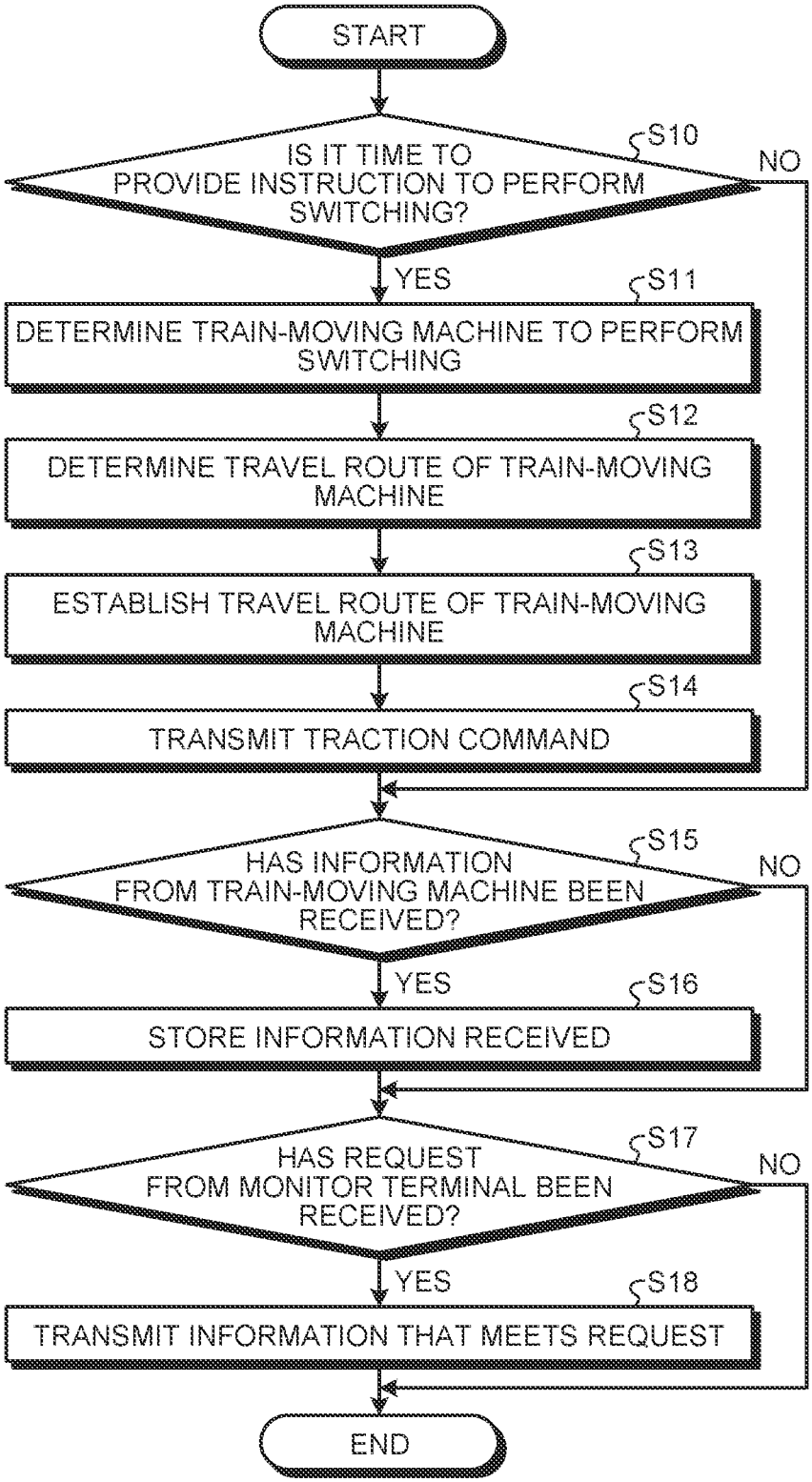
FIG. 13 is a flowchart illustrating an example of process performed by the processing unit of the control device according to the first embodiment.

A process performed by the processing unit 13 of the control device 7 will next be described with reference to a flowchart. FIG. 13 is a flowchart illustrating an example of process performed by the processing unit of the control device according to the first embodiment. The processing unit 13 of the control device 7 repeatedly performs the process illustrated in FIG. 13.

As illustrated in FIG. 13, the processing unit 13 of the control device 7 determines whether it is time to provide an instruction to perform switching, based on the operation schedule information stored in the storage unit 12 (step S10). If it is determined that it is time to provide an instruction to perform switching (step S10: Yes), the processing unit 13 determines the train-moving machine 8 that is to perform switching based on the operation schedule information and on the state information of each of the train-moving machines 8 stored in the storage unit 12 (step S11).

Next, the processing unit 13 determines the travel route of the train-moving machine 8 that is to perform switching, based on the operation schedule information stored in the storage unit 12 and on information of the current location of the train-moving machine 8 determined by the operation at step S11 (step S12). The processing unit 13 establishes the travel route of the train-moving machine 8 determined by the operation at step S12 (step S13). In the operation at step S13, the processing unit 13 generates a switch command based on the travel route determined by the operation at step S12, and causes the first communication unit 10 to transmit the switch command generated, to the coordinator device 6. This causes the coordinator device 6 to control the applicable one or ones of the switches 4, thereby establishing the travel route of the train-moving machine 8 in the rail yard 2.

Next, the processing unit 13 causes the second communication unit 11 to transmit a traction command to the train-moving machine 8 determined by the operation at step S12 (step S14). Such traction command includes, for example, information of each of the traction start location, the traction end location, the travel route, and the waiting location.

When the operation at step S14 is complete, or when it is determined that it is not time to provide an instruction to perform switching (step S10: No), the processing unit 13 determines whether information from the train-moving machine 8 has been received by the second communication unit 11 (step S15). If it is determined that information from the train-moving machine 8 has been received (step S15: Yes), the processing unit 13 obtains the information from the train-moving machine 8 received by the second communication unit 11, and stores the information obtained, in the storage unit 12 (step S16).

When the operation at step S16 is complete, or when it is determined that no information from the train-moving machine 8 has been received (step S15: No), the processing unit 13 determines whether a request from the monitor terminal 91 has been received by the first communication unit 10 (step S17). If it is determined that a request from the monitor terminal 91 has been received by the first communication unit 10 (step S17: Yes), the processing unit 13 obtains, from the first communication unit 10, the request from the monitor terminal 91, generates information meeting the request from the monitor terminal 91, and causes the first communication unit 10 to transmit the information generated, to the monitor terminal 91 (step S18).

When the operation at step S18 is complete, or when it is determined that no request from the monitor terminal 91 has been received by the first communication unit 10 (step S17: No), the processing unit 13 terminates the process illustrated in FIG. 13.

Figure 14:
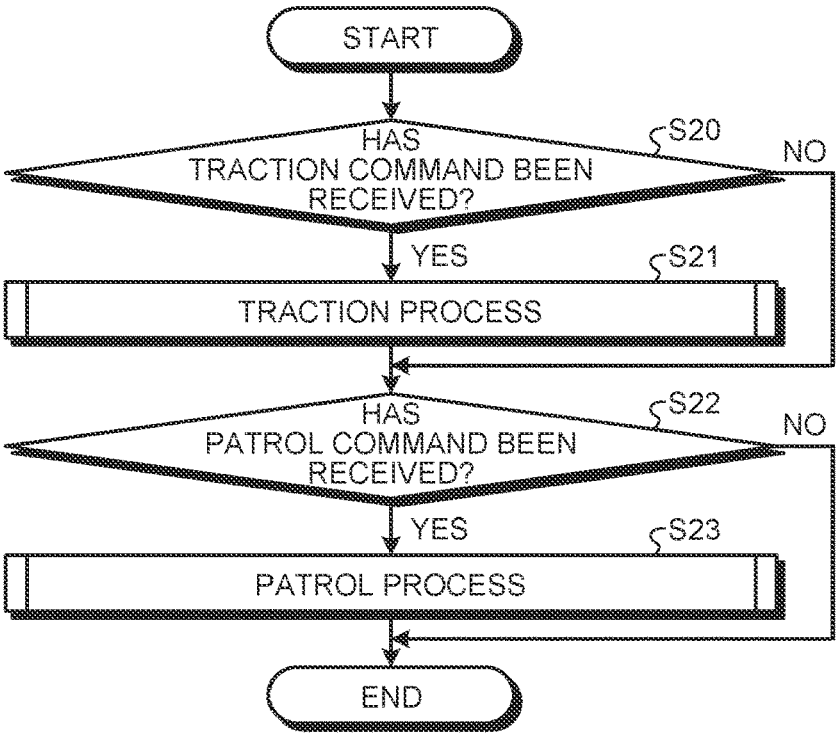
FIG. 14 is a flowchart illustrating an example of process performed by the processing unit of the train-moving machine according to the first embodiment.

A process performed by the processing unit 36 of the train-moving machine 8 will next be described with reference to a flowchart. FIG. 14 is a flowchart illustrating an example of process performed by the processing unit of the train-moving machine according to the first embodiment. The processing unit 36 of the train-moving machine 8 repeatedly performs the process illustrated in FIG. 14.

As illustrated in FIG. 14, the processing unit 36 of the train-moving machine 8 determines whether a traction command has been received by the wireless communication unit 30 (step S20). If it is determined that a traction command has been received by the wireless communication unit 30 (step S20: Yes), the processing unit 36 performs a traction process (step S21). Such traction process is a set of operations at steps S30 to S34 illustrated in FIG. 15, which will be described later in detail.

When the operation at step S21 is complete, or when it is determined that no traction command has been received (step S20: No), the processing unit 36 determines whether a patrol command has been received by the wireless communication unit 30 (step S22). If it is determined that a patrol command has been received (step S22: Yes), the processing unit 36 performs a patrol process (step S23). Such patrol process is a set of operations at steps S40 to S43 illustrated in FIG. 16, which will be described later in detail.

When the operation at step S23 is complete, or when it is determined that no patrol command has been received by the wireless communication unit 30 (step S22: No), the processing unit 36 terminates the process illustrated in FIG. 14.

Figure 15:
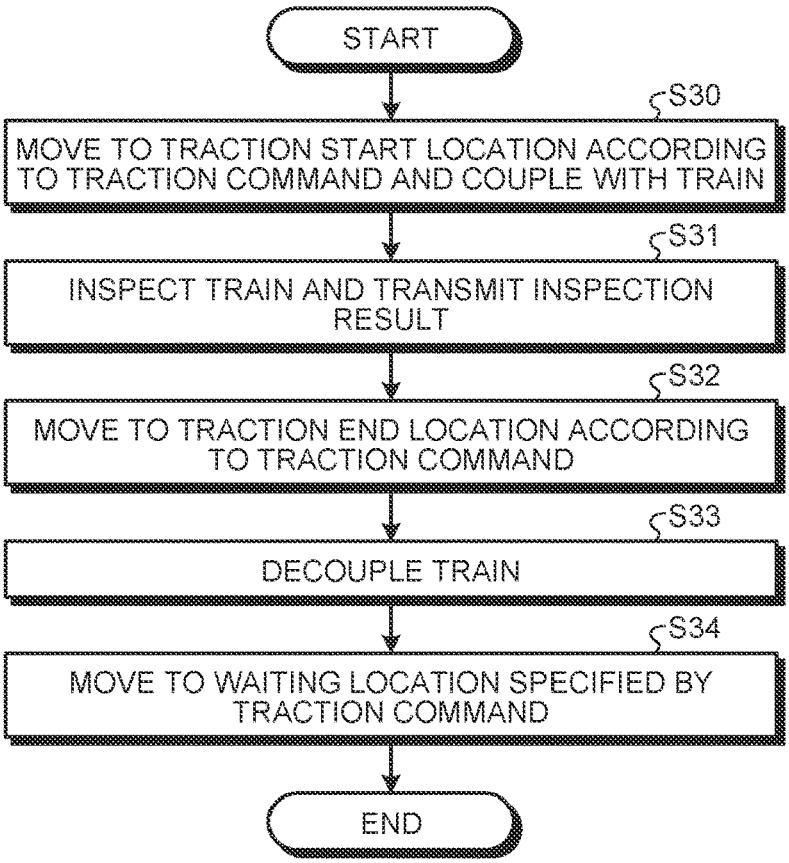
FIG. 15 is a flowchart illustrating an example of traction process performed by the processing unit of the train-moving machine according to the first embodiment.

FIG. 15 is a flowchart illustrating an example of the traction process performed by the processing unit of the train-moving machine according to the first embodiment. As illustrated in FIG. 15, the processing unit 36 operates the first drive unit 33 in accordance with the traction command transmitted from the control device 7 and received by the wireless communication unit 30 to cause the train-moving machine 8 to move to the traction start location and to cause the train-moving machine 8 to couple with an applicable one of the trains 1 at the traction start location (step S30).

Next, the processing unit 36 inspects the train 1 based on a result of detection performed by a sensor 31 for detecting the states of the trains 1, and causes the wireless communication unit 30 to transmit an inspection result to the control device 7 (step S31). In the operation at step S31, the processing unit 36 inspects the train 1 based on, for example, an image of the train 1 captured by a sensor 31, and causes the wireless communication unit 30 to transmit an inspection result to the control device 7.

Note that the processing unit 36 is also capable of inspecting a train-moving machine 8 at a location other than the traction start location in place of, or in addition to, inspection of the train-moving machine 8 at the traction start location. For example, the processing unit 36 is capable of inspecting a train 1 that is approaching the train-moving machine 8 based on a result of detection performed by a sensor 31 for detecting the states of the trains 1. The processing unit 36 is also capable of inspecting a train-moving machine 8, different from one to be drawn, that is moving for switching.

Next, the processing unit 36 operates the first drive unit 33 in accordance with the traction command to cause the train-moving machine 8 to move to the traction end location (step S32). The processing unit 36 then controls the coupling 32 to cause the train-moving machine 8 to decouple the train 1 (step S33). After decoupling of the train 1, the processing unit 36 operates at least one of the first drive unit 33 and the second drive unit 34 to move the train-moving machine 8 to the waiting location specified by the traction command (step S34), and terminates the process illustrated in FIG. 15.

Figure 16:
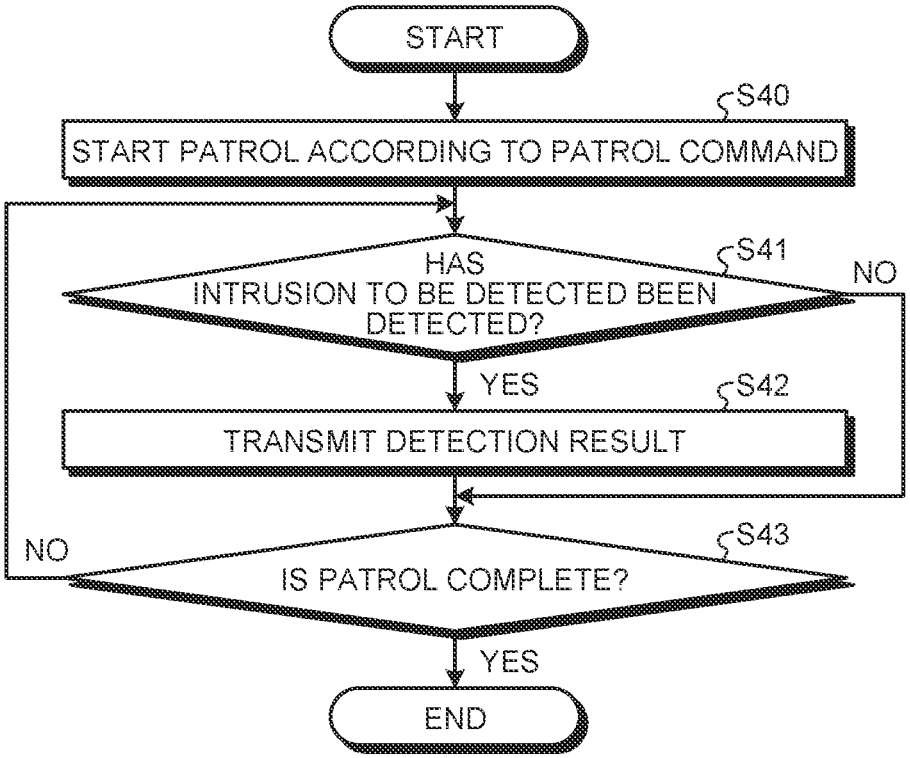
FIG. 16 is a flowchart illustrating an example of patrol process performed by the processing unit of the train-moving machine according to the first embodiment.

FIG. 16 is a flowchart illustrating an example of the patrol process performed by the processing unit of the train-moving machine according to the first embodiment. As illustrated in FIG. 16, the processing unit 36 operates the first drive unit 33 in accordance with the patrol command transmitted from the control device 7 and received by the wireless communication unit 30 to cause the train-moving machine 8 to start patrol (step S40).

After the train-moving machine 8 starts patrol, the processing unit 36 determines whether an intrusion to be detected has been detected based on information obtained from a sensor 31 (step S41). If it is determined that an intrusion to be detected has been detected (step S41: Yes), the processing unit 36 causes the wireless communication unit 30 to transmit a detection result indicating that an intrusion to be detected has been detected, to the control device 7 (step S42). Note that the processing unit 36 is also capable of causing the wireless communication unit 30 to transmit, to the control device 7, a detection result indicating the presence or absence of an intrusion to be detected regardless of whether an intrusion to be detected has been detected or not.

When the operation at step S42 is complete, or when it is determined that no intrusion to be detected has been detected (step S41: No), the processing unit 36 determines whether the patrol in accordance with the patrol command is complete (step S43). If it is determined that the patrol is not yet complete (step S43: No), the processing unit 36 returns the process back to step S41. If it is determined that the patrol is complete (step S43: Yes), the processing unit 36 terminates the process illustrated in FIG. 16. Note that the processing unit 36 is also capable of inspecting the train-moving machine 8 during patrol.

Note that the above example assumes that the processing unit 13 of the control device 7 determines the travel route, but the travel route can be determined by the processing unit 36 of the train-moving machine 8 determined by the control device 7 to be the train-moving machine 8 that is to perform switching. For example, the processing unit 36 of the train-moving machine 8 is capable of determining the first travel route and the second travel route based on the traction start location and on the traction end location included in the traction command.

In addition, the processing unit 36 of the train-moving machine 8 is capable of transmitting and receiving information to and from another train-moving machine 8 via wireless communication using the wireless communication unit 30. The processing unit 36 of the train-moving machine 8 is capable of determining the first travel route and the second travel route based on information obtained from another train-moving machine 8. An example of the information obtained from another train-moving machine 8 is information of the travel route for use in switching performed by another train-moving machine 8.

After determination of the first travel route and the second travel route, the processing unit 36 of the train-moving machine 8 is capable of requesting the control device 7 to establish the first travel route and the second travel route via the wireless communication unit 30. The control device 7 is capable of generating a switch command based on the request from the train-moving machine 8, and causing the first communication unit 10 to transmit the switch command generated, to the coordinator device 6. Note that the processing unit 36 of the train-moving machine 8 is also capable of generating a switch command in accordance with the first travel route and with the second travel route, and causing the wireless communication unit 30 to transmit the switch command generated, to the coordinator device 6.

In addition, although the rail yard train-switching system 100 described above is configured to include the multiple train-moving machines 8, the number of the train-moving machines 8 may be one. Moreover, although the rail yard train-switching system 100 described above manages a single rail yard 2, the rail yard train-switching system 100 may be configured to manage multiple rail yards 2.

Figure 17:
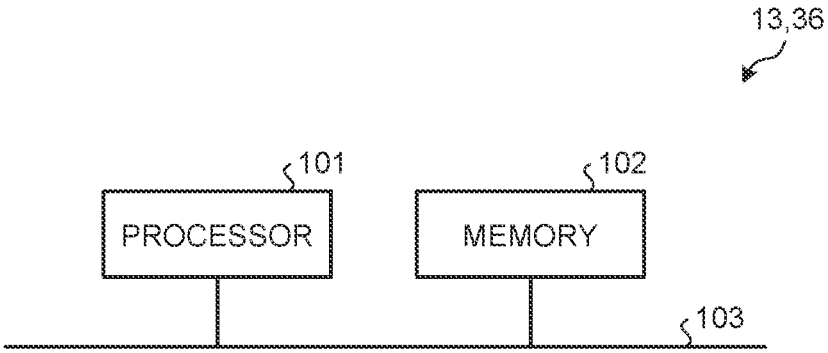
FIG. 17 is a diagram illustrating an example of hardware configuration of each of the processing unit of the control device and the processing unit of the train-moving machine according to the first embodiment.

FIG. 17 is a diagram illustrating an example of hardware configuration of each of the processing unit of the control device and the processing unit of the train-moving machine according to the first embodiment. As illustrated in FIG. 17, each of the processing units 13 and 36 includes a computer including a processor 101 and a memory 102.

The processor 101 and the memory 102 can exchange information with each other via, for example, a bus 103. The processor 101 reads and executes a program stored in the memory 102 to implement the functionality of the processing unit 13. In addition, the processor 101 reads and executes a program stored in the memory 102 to implement the functionality of the processing unit 36. The processor 101 is an example of, for example, a processing circuit, and includes one of more of a central processing unit (CPU), a digital signal processor (DSP), and a system large scale integration (LSI).

The memory 102 includes one or more of a random access memory (RAM), a read-only memory (ROM), a flash memory, an erasable programmable read-only memory (EPROM), and an electrically erasable programmable read-only memory (EEPROM) (registered trademark). The memory 102 also includes a recording medium that records a computer-readable program. Such recording medium includes one or more of a non-volatile or volatile semiconductor memory, a magnetic disk, a flexible memory, an optical disk, a compact disc, and a digital versatile disc (DVD). Note that each of the processing units 13 and 36 may include an integrated circuit such as an application specific integrated circuit (ASIC) and a field programmable gate array (FPGA).

As described above, the rail yard train-switching system 100 according to the first embodiment includes a train-moving machine 8 and a control device 7. The train-moving machine 8 draws a train 1 in the rail yard 2. The control device 7 transmits a traction command to the train-moving machine 8 based on an operation schedule. The train-moving machine 8 moves, based on the traction command transmitted from the control device 7, to a traction start location specified by the traction command to couple with the train 1, and draws the train 1 from the traction start location to a traction end location specified by the traction command. The traction start location is an example of a first location. The traction end location is an example of a second location. This enables the rail yard train-switching system 100 to reduce or eliminate operational errors each caused by a human error, thereby enabling a switching operation of a train 1 to be efficiently performed in the rail yard 2. The rail yard train-switching system 100 also eliminates the need for operation of a train-moving machine by a qualified person permitted to operate the train-moving machine unlike a conventional system, and merely requires to monitor switching of the multiple trains 1 by a reduced number of personnel, thereby enabling a reduction in the number of qualified persons in the rail yard 2.

In addition, the control device 7 includes the moving machine determination unit 22. The moving machine determination unit 22 determines the train-moving machine 8 that is to receive the traction command among the multiple train-moving machines 8, based on the states of the respective multiple train-moving machines 8. This enables the rail yard train-switching system 100 to determine an appropriate one of the train-moving machines 8 in consideration of the states of the respective train-moving machines 8 to be the train-moving machine 8 that is to perform switching.

The control device 7 also includes the route determination unit 23. The route determination unit 23 determines a first travel route to the traction start location of the train-moving machine 8 and a second travel route from the traction start location to the traction end location of the train-moving machine 8. This enables the rail yard train-switching system 100 to manage the travel route of the train-moving machine 8, thereby enabling a switching operation of a train 1 to be efficiently performed in the rail yard 2.

In addition, the control device 7 transmits an entry prohibition command, which prohibits the train-moving machines 8 other than the train-moving machine 8 that receives the traction command, among the multiple train-moving machines 8, from entering the first travel route and the second travel route. This enables the rail yard train-switching system 100 to prevent interruption of switching performed by the train-moving machine 8 by another train-moving machine 8, thereby enabling a switching operation of a train 1 to be efficiently performed in the rail yard 2.

In addition, the multiple ones of the train-moving machines 8 move, based on the traction command, a train 1 specified by the traction command in conjunction with each other. This enables the rail yard train-switching system 100 to perform a switching operation of a train 1 efficiently in the rail yard 2 even when, for example, a single train-moving machine 8 is insufficient to draw the train 1.

In addition, the train-moving machine 8 includes the target detection unit 44 for detecting an intrusion to be detected into the rail yard 2. The control device 7 transmits a patrol command to the train-moving machine 8 based on a preconfigured patrol schedule. The train-moving machine 8 patrols the rail yard 2 while detecting presence or absence of an intrusion to be detected using the target detection unit 44, based on the patrol command transmitted from the control device 7. This enables the rail yard train-switching system 100 to cause the train-moving machine 8 to function as a security facility, thereby enabling the security facility that is to be installed in the rail yard 2 to be simplified.

The train-moving machine 8 also includes the one or more sensors 31 for inspecting the train 1 specified by the traction command. The control device 7 or the train-moving machine 8 inspects the train 1 specified by the traction command, based on a result of detection performed by the one or more sensors 31. This enables the rail yard train-switching system 100 to inspect the trains 1 in the rail yard 2.

In addition, the one or more sensors 31 include an image sensor. The control device 7 or the train-moving machine 8 compares an image of the train 1 specified by the traction command, captured by the image sensor with an image of the train 1 in a normal condition to detect an anomaly such as damage or deformation of the train 1. This enables the rail yard train-switching system 100 to inspect the trains 1 in the rail yard 2 using, for example, the one or more sensors 31 for use in switching.

The configurations described in the foregoing embodiment are merely examples. These configurations may be combined with a known other technology, and a part of the configurations may be omitted and/or modified without departing from the spirit thereof.

REFERENCE SIGNS LIST

1, $\mathbf{1}_1$, $\mathbf{1}_2$, $\mathbf{1}_3$, $\mathbf{1}_4$, . . . , $\mathbf{1}_n$ railroad train; 2 rail yard; 3, $\mathbf{3}_1$-$\mathbf{3}_{14}$ track; 4, $\mathbf{4}_1$-$\mathbf{4}_{14}$ switch; 5 inspection and repair shop; 6 coordinator device; 7 control device; 8, $\mathbf{8}_1$, $\mathbf{8}_2$, $\mathbf{8}_3$, $\mathbf{8}_4$, . . . , $\mathbf{8}_m$ train-moving machine; 9 central control room; 10 first communication unit; 11 second communication unit; 12, 35 storage unit; 13, 36 processing unit; 20, 40 information acquisition unit; 21, 41 information output unit; 22 moving machine determination unit; 23 route determination unit; 24 route establishment unit; 25 command processing unit; 26, 45 inspection processing unit; 30 wireless communication unit; 31, $\mathbf{31}_1$-$\mathbf{31}_k$ sensor; 32 coupling; 33 first drive unit; 34 second drive unit; 42 movement control unit; 43 coupling control unit; 44 target detection unit; 50, 51, 53 QR code; 60 intruder; 80, 82, 83 monitor image; 81 operation schedule management image; 91 monitor terminal; 100 rail yard train-switching system.

The invention claimed is:

1. A rail yard train-switching system comprising:

a plurality of train-moving machines to draw a railroad train in a rail yard; and a controller comprising a processor and a memory and configured to select a train-moving machine of the plurality of train-moving machines to perform a switching operation based on states of the plurality of train-moving machines and to transmit a traction command to the selected train-moving machine based on an operation schedule of the switching operation including a start time for the traction command, wherein the selected train-moving machine moves, based on the traction command transmitted from the controller, to a first location specified by the traction command to couple with the railroad train, and draws the railroad train from the first location to a second location specified by the traction command, wherein the selected train-moving machine includes a target detection circuitry to detect an intrusion to be detected into the rail yard, the controller transmits a patrol command to the selected train-moving machine based on a preconfigured patrol schedule, and the selected train-moving machine patrols the rail yard while detecting presence or absence of the intrusion to be detected using the target detection circuitry, based on the patrol command transmitted from the controller.

2. The rail yard train-switching system according to claim 1, wherein the controller includes a route determination circuitry to determine a first travel route to the first location of the selected train-moving machine, and a second travel route from the first location to the second location of the selected train-moving machine, and a route establishment circuitry to cause a coordinator device to control a switch in the rail yard, based on the first travel route and on the second travel route determined by the route determination circuitry.

3. The rail yard train-switching system according to claim 2, wherein the controller transmits an entry prohibition command prohibiting ones of the plurality of the train-moving machines other than the selected train-moving machine that receives the traction command, among the plurality of the train-moving machines, from entering the first travel route and the second travel route.

4. The rail yard train-switching system according to claim 1, wherein the plurality of train-moving machines move, based on the traction command, in conjunction with each other a railroad train specified by the traction command.

5. The rail yard train-switching system according to claim 1, wherein the selected train-moving machine includes a sensor for inspecting the railroad train, and the controller or the selected train-moving machine inspects the railroad train based on a result of detection performed by the sensor.

6. The rail yard train-switching system according to claim 5, wherein the sensor is an image sensor, and the controller or the selected train-moving machine compares an image of the railroad train captured by the image sensor with an image of the railroad train in a normal condition to detect an anomaly of the railroad train.

* * * * *